US006062306A

United States Patent [19]

Gano et al.

[11] Patent Number: 6,062,306

[45] Date of Patent: May 16, 2000

[54] SEALED LATERAL WELLBORE JUNCTION ASSEMBLED DOWNHOLE

[75] Inventors: John C. Gano, Carrollton; Joseph D. Parlin, Plano; John S. Bowling, Dallas; James R. Longbottom, Magnolia; Dana R. Dale, Houston, all of Tex.

[73] Assignee: Halliburton Energy Services, Inc., Dallas, Tex.

[21] Appl. No.: 09/014,313

[22] Filed: Jan. 27, 1998

[51] Int. Cl.[7] ..... E03B 03/11

[52] U.S. Cl. ..... 166/50; 166/313; 166/380

[58] Field of Search ..... 166/50, 117.6, 166/313, 380

[56] References Cited

U.S. PATENT DOCUMENTS

| | | | |
|---|---|---|---|
| 5,353,876 | 10/1994 | Curington et al. | 166/313 |
| 5,462,120 | 10/1995 | Gondouin | 166/380 |
| 5,787,987 | 8/1998 | Forsyth et al. | 166/313 |

FOREIGN PATENT DOCUMENTS

| | | |
|---|---|---|
| 0859121 A2 | 8/1998 | European Pat. Off. . |
| 2297779 | 8/1996 | United Kingdom . |
| 2304764 | 9/1996 | United Kingdom . |
| 2304764 | 3/1997 | United Kingdom . |

*Primary Examiner*—William Neuder
*Assistant Examiner*—Zakiya Walker
*Attorney, Agent, or Firm*—William M. Imwalle; Marlin R. Smith

[57] ABSTRACT

Apparatus and methods are provided for completing a wellbore junction. In one embodiment described herein, a lateral wellbore junction is sealed utilizing an apparatus assembled within the well. The apparatus may include multiple housings which are engaged with each other to form a sealed assembly with flow passages extending into the lateral wellbore, and upper and lower portions of a parent wellbore. Associated sealing devices and flexible couplings are also provided.

48 Claims, 21 Drawing Sheets

FIG. 12A
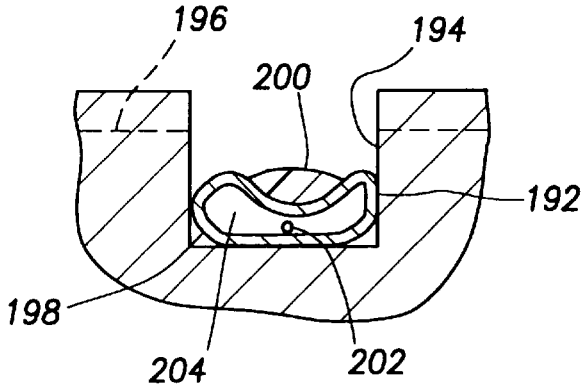
FIG. 12B
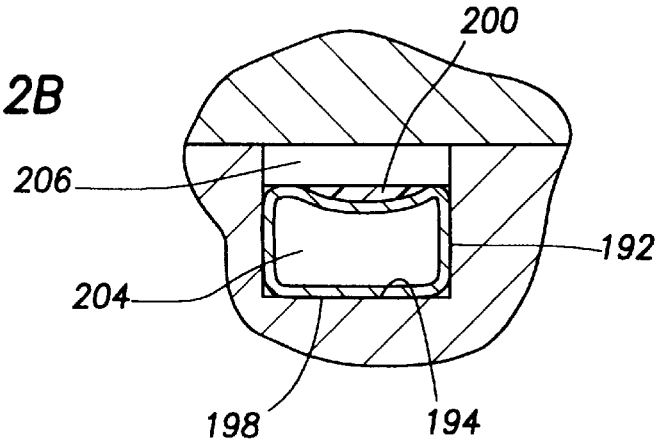
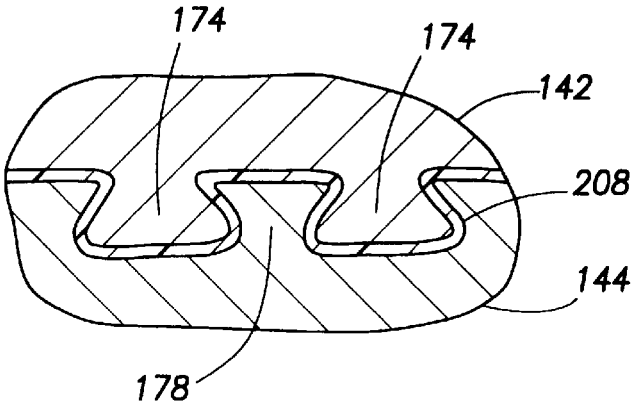
FIG. 13

FIG. 14
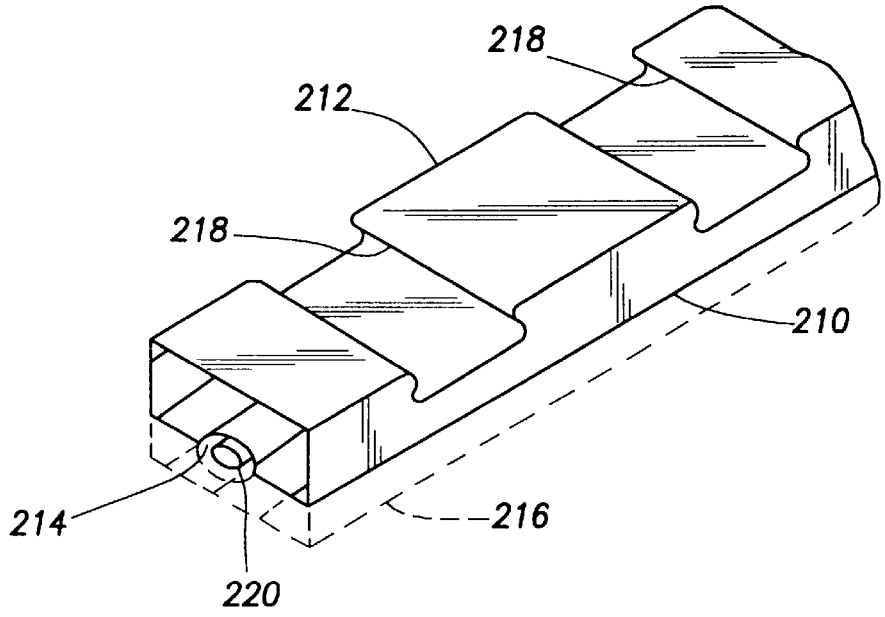
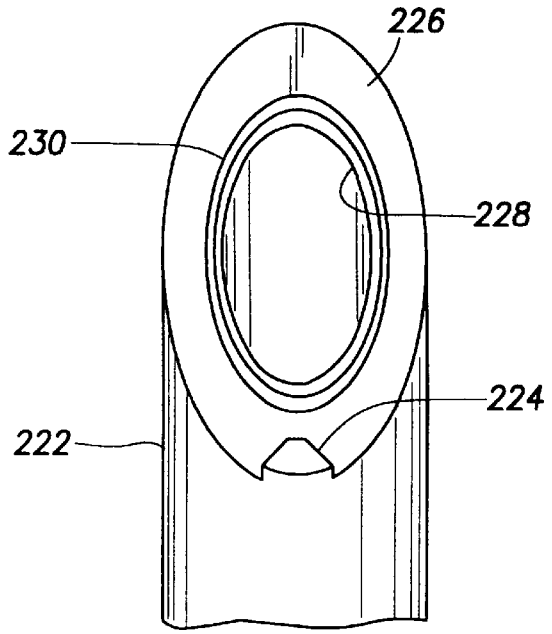
FIG. 15

FIG. 16
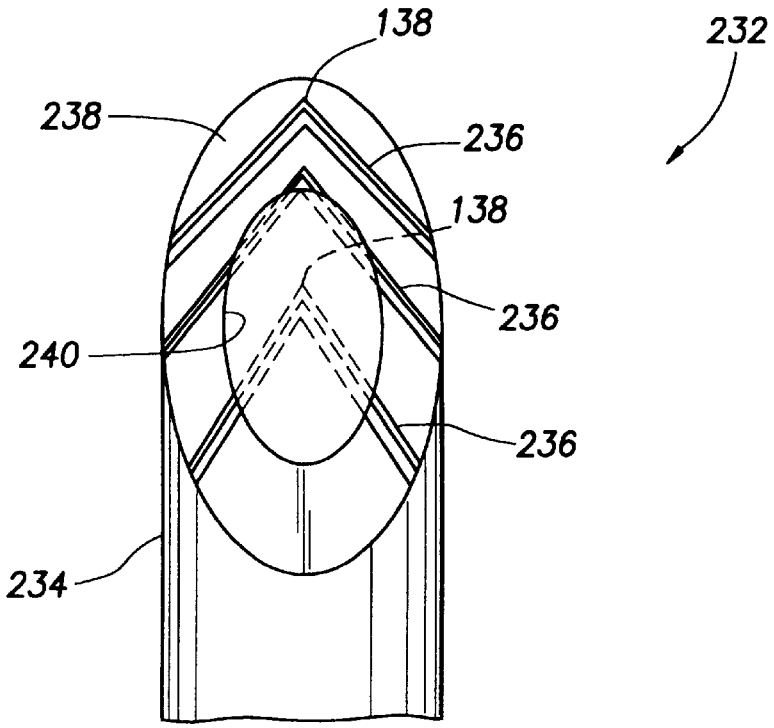
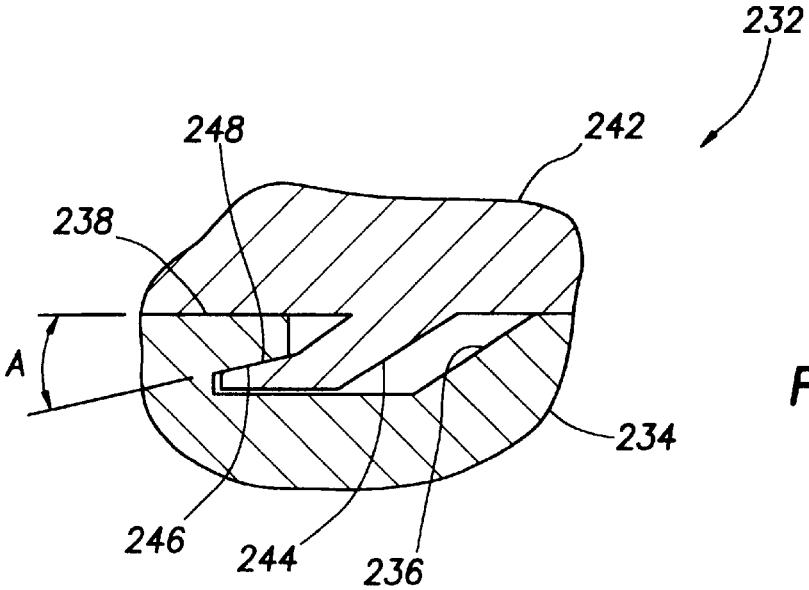
FIG. 17

FIG.30
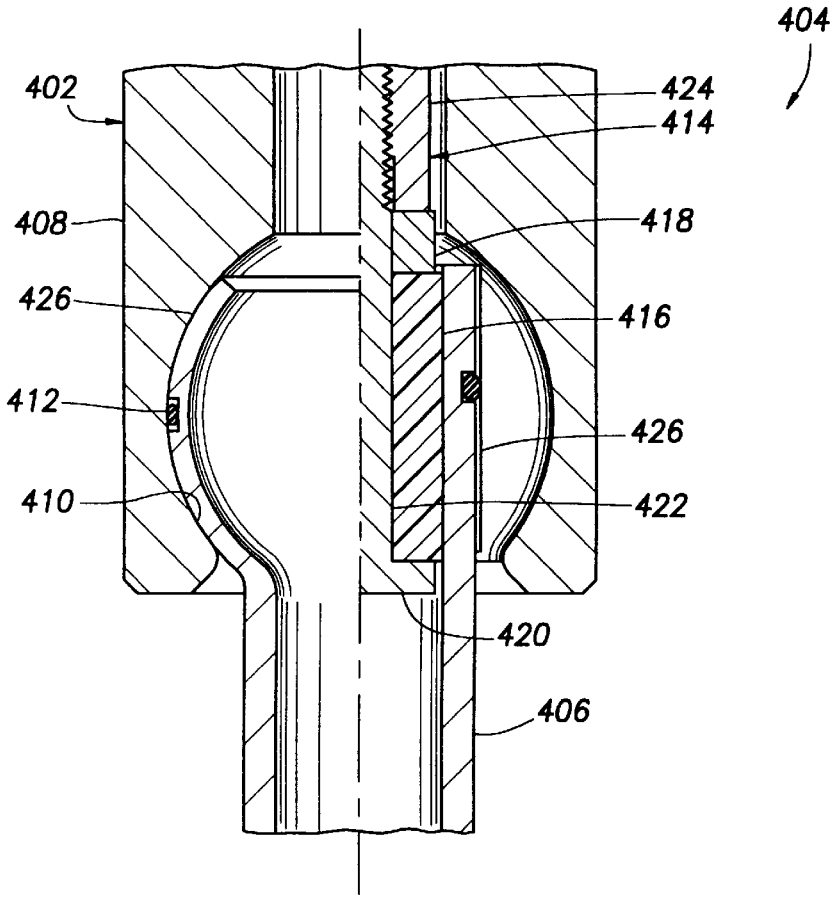
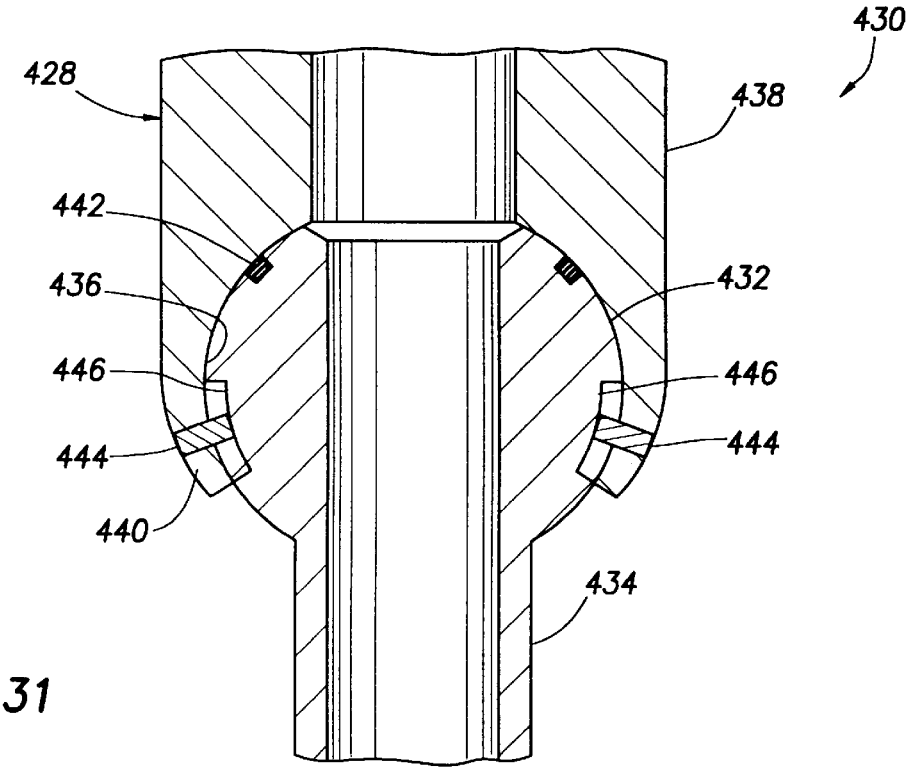
FIG.31

SEALED LATERAL WELLBORE JUNCTION ASSEMBLED DOWNHOLE

BACKGROUND OF THE INVENTION

The present invention relates generally to operations performed in conjunction with a subterranean well and, in an embodiment described herein, more particularly provides apparatus and methods for completing a wellbore junction.

Lateral wellbores are frequently drilled extending outwardly from parent wellbores. A problem associated with the junctions between these parent and lateral wellbores is how to provide access to each of the wellbores, while isolating flow passages therein and preventing migration of fluids between formations intersected by the junctions from other formations intersected by the wellbores. Many solutions have been proposed for solving this problem, however, most of these rely upon cement for isolating the flow passages and preventing migration of fluids, and/or require additional drilling or milling through the cement or tubular members positioned in the junction.

It would be advantageous to provide a lateral wellbore junction in which an apparatus may be assembled which provides access to the lateral and parent wellbores. The apparatus should include flow passages extending through housings adapted for connection to tubular members extending into the lateral wellbore, and the upper and lower parent wellbores. Fluid may then flow, and equipment may pass, from or into each of the wellbores through the flow passages in the apparatus and, thus, through the wellbore junction.

The apparatus should also include provisions for securing the housings to each other, so that the apparatus is not damaged or rendered ineffective by temperature and pressure variations, etc. The method of securing the housings to each other should be convenient and economical to perform. Additionally, the method should be performable within the well.

The apparatus should include provisions for sealing the housings, so that the flow passages therein are isolated from fluid communication with the wellbores in which the housings are positioned. Since the housings may be assembled to each other within the well, the method of sealing should accommodate and be compatible with the method of securing the housings to each other.

Furthermore, the apparatus should be adapted for use in an overall wellbore junction completion in which the formation intersected by the wellbore junction is isolated from other formations intersected by the wellbores. Thus, the housings of the apparatus should be configured for attachment to tubular members extending into, and sealingly engaged within, each of the wellbores.

It is an object of the present invention to provide such an apparatus and associated methods of completing a wellbore junction. Accordingly, a sealed lateral wellbore junction, including an apparatus which is assembled downhole, is described below in a particular embodiment of the invention. Additionally, apparatus and methods which facilitate the wellbore junction completion are also provided.

SUMMARY OF THE INVENTION

In carrying out the principles of the present invention, in accordance with an embodiment thereof, apparatus is provided which includes a unique assemblage of housings, utilization of which does not require drilling or milling through cement, metal or other members, but which accomplishes the objectives of providing access to wellbores intersecting at the junction, providing a flow passage therethrough for each wellbore, isolating the flow passages and preventing migration of fluids in the wellbores. The apparatus is conveniently and economically assemblable downhole. Methods of completing wellbore junctions are also provided.

In one embodiment, a first housing having a flow passage therein is positioned at the wellbore junction with an end thereof extending into one of the wellbores. A second housing is then conveyed into the wellbore and engaged with the first housing, so that the flow passage in the first housing is placed in communication with a flow passage in the second housing. The housings are secured to each other by complementarily shaped interlocking profiles formed on the housings.

The housings may be sealed to each other utilizing any of a variety of sealing devices described below. The sealing device may be carried on either of the housings, and may be disposed on or adjacent to the interlocking profiles. In addition, the sealing device may be extendable after the housings are joined, in order to close any gap between the housings. The sealing device may also form a metal-to-metal seal between the housings.

In another embodiment of the invention, a sleeve or other retaining member may be used to secure the housings relative to the wellbores. In this manner, the wellbore junction is stabilized, reducing the possibility that the housings may be dislocated or the seal therebetween compromised.

These and other features, advantages, benefits and objects of the present invention will become apparent to one of ordinary skill in the art upon careful consideration of the detailed descriptions of representative embodiments of the invention hereinbelow and the accompanying drawings.

BRIEF DESCRIPTION OF THE DRAWINGS

FIGS. 12A & 12B are cross-sectional views of a method of sealing the third apparatus;

FIG. 13 is a cross-sectional view of an alternate method of sealing the third apparatus;

FIG. 14 is a partially elevational and partially cross-sectional view of an alternate seal for use in the third apparatus;

FIG. 15 is an elevational view of a fourth method and apparatus embodying principles of the present invention;

FIG. 16 is an elevational view of a fifth method and apparatus embodying principles of the present invention;

FIG. 17 is a cross-sectional view of a portion of the fifth apparatus;

FIG. 30 is a cross-sectional view of a ninth apparatus embodying principles of the present invention;

FIG. 31 is a cross-sectional view of a tenth apparatus embodying principles of the present invention.

DETAILED DESCRIPTION

Figure 1:
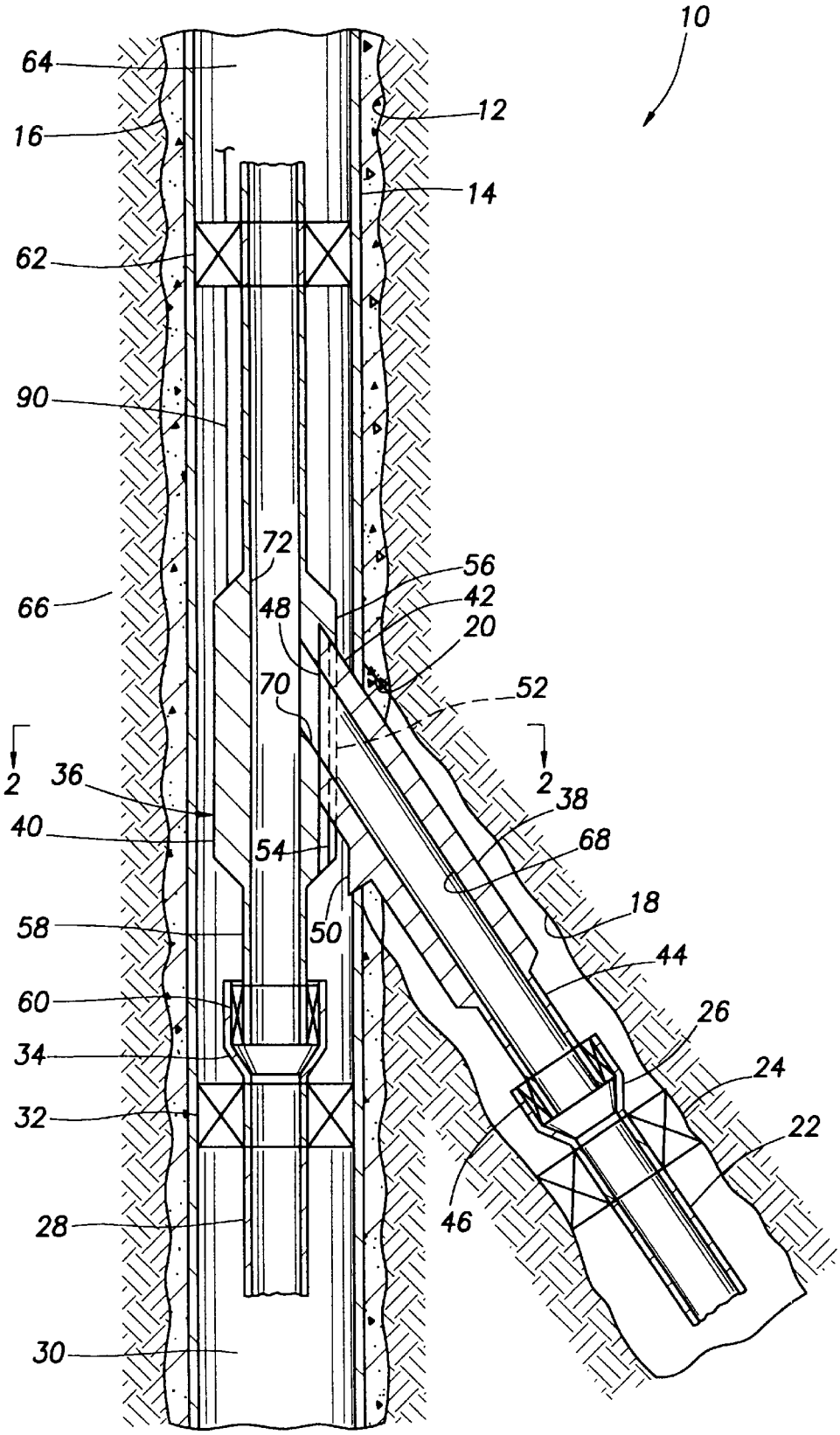
FIG. 1 is a cross-sectional view of a first method and apparatus embodying principles of the present invention.

Representatively and schematically illustrated in FIG. 1 is a method 10 which embodies principles of the present invention. In the following description of the method 10 and other methods and apparatus described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a parent wellbore 12 is drilled, lined with protective casing 14, and cement 16 is disposed between the casing and the earth thereabout. A lateral wellbore 18 is then drilled extending outwardly from the parent wellbore 12 via an opening or window 20 cut laterally through the casing 14 and cement 16. This operation may be performed utilizing conventional methods, such as by positioning a whipstock or other deflection device in the parent wellbore 12 and deflecting mills, drills, and/or other cutting tools off of the deflection device to form the window 20 and extend the lateral wellbore 18.

A liner 22 or other tubular member is conveyed into the well and positioned in the lateral wellbore 18. The liner 22 has an inflatable packer 24 or other sealing and/or anchoring device attached thereto between the liner and a polished bore receptacle (PBR) 26. The liner 22 may also be cemented within the lateral wellbore 18 and may be otherwise sealed within the lateral wellbore without using the packer 24.

In a similar manner, a liner 28 or other tubular member is conveyed into a lower portion 30 of the parent wellbore 12 and sealingly anchored therein by a packer 32 attached between the liner and a PBR 34. Note that the liners 22, 28, packers 24, 32 and PBR's 26, 34 are positioned in the lateral and lower parent wellbores 18, 30, respectively, relative to the junction of the lateral and parent wellbores, so that an assembly 36 may be positioned within the junction and sealingly engaged with the PBR's as shown in FIG. 1. of course, the assembly 36 could be otherwise sealingly engaged with the lateral and lower parent wellbores 18, 30, without departing from the principles of the present invention, for example, by providing packers on the assembly for this purpose.

The assembly 36 includes a lateral wellbore housing 38 and a parent wellbore housing 40, however, it is to be clearly understood that the housing 38 could be positioned in the parent wellbore 12, and the housing 40 could be positioned in the lateral wellbore 18, without departing from the principles of the present invention. If the housings 38, 40 are otherwise positioned, it will be readily apparent that suitable modifications may be made in the method 10 and the assembly 36 to accommodate the alternate positioning.

As representatively illustrated in FIG. 1, the housing 38 is conveyed into the well and positioned in the lateral wellbore 18 with an end portion 42 thereof extending into the parent wellbore 12 at the wellbore junction. A lower end 44 of the housing 38 has a sealing device 46, such as a packing stack or other seal member, carried thereon, which is sealingly inserted into the PBR 26. Such engagement between the housing 38 and the PBR 26 may serve to fix the longitudinal position of the housing in the lateral wellbore 18 relative to the wellbore junction, and a conventional orienting nipple or other orienting device, such as a gyroscope or high-side indicator, may be used to rotationally orient the end portion 42 relative to the wellbore junction as shown in FIG. 1. Preferably, the end portion 42 is oriented so that an end surface 48 of the end portion is generally parallel to the longitudinal axis of the parent wellbore 12. A projection 50 extending radially outward from the housing 38 may be used to engage a peripheral edge portion of the window 20 and restrict displacement of the housing longitudinally into the lateral wellbore 18.

With the housing 38 positioned as shown in FIG. 1, the parent wellbore housing 40 is then conveyed into the parent wellbore 12 and engaged with the lateral wellbore housing 38. Such engagement is performed by interlocking complementarily shaped profiles 52, 54 formed on the housings 38, 40, respectively. The profile 52 is formed on the end portion 42 and extends generally parallel to the end surface 48. The profile 54 is formed on a sidewall 56 of the housing 40. Thus, the housing 38 end portion 42 is slidably engaged with the housing 40 sidewall 56.

A lower end 58 of the housing 40 has a sealing device 60 carried thereon, which is sealingly received within the PBR 34. As with the housing 38 discussed above, the housing 40 may be longitudinally positioned within the parent wellbore 12 utilizing such engagement, and conventional methods may be used to rotationally orient the housing 40 relative to the housing 38 and the wellbore junction. The sealing device 60 may include an anchoring device, such as if the sealing device is a packer, and the sealing device may be directly sealed within the lower parent wellbore 30.

A packer 62 or other sealing and/or anchoring device, such as a tubing or liner hanger, etc., is attached above the housing 40. The packer 62 is set within the casing 14 in an upper portion 64 of the parent wellbore 12. Thus, the packer 62 prevents disengagement of the housing 40 from the housing 38 and prevents flow of fluid between the wellbore junction and the upper parent wellbore 64 above the packer. In a similar manner, the packers 24, 32 prevent flow of fluid between the wellbore junction and the lateral wellbore 18 below the packer 24, and the lower parent wellbore 30 below the packer 32, respectively. Thus, it will be readily appreciated that the packers 24, 32, 62 prevent migration of fluids between a formation 66 intersected by the wellbore junction and other formations intersected by the parent and lateral wellbores 12, 18 through the wellbores.

Engagement between the housings 38, 40 provides several other benefits as well. An internal flow passage 68 formed axially through the housing 38 is aligned with a flow passage 70 formed laterally through the housing 40 sidewall 56, thereby permitting communication therebetween and permitting access therethrough to the lateral wellbore 18. In the housing 40, the flow passage 70 intersects another flow passage 72 formed axially therethrough. The end portion 42 is secured to the sidewall 56, thus preventing displacement of the housing 38 laterally relative to the housing 40. As described more fully below, this permits a pressure-bearing seal to be formed between the flow passages 68, 70, thereby isolating the flow passages from the exterior of the housings 38, 40.

The housings 38, 40 may be biased toward engagement with each other in order to maintain the engagement therebetween. For example, the housing 40 may be axially downwardly biased by the packer 62 when it is set in the casing 14. If the sealing device 60 is a packer or otherwise includes an anchoring device, it may instead or additionally downwardly bias the housing 40. Of course, other methods of maintaining engagement between the housings 38, 40 may be utilized without departing from the principles of the present invention.

Figure 2A:
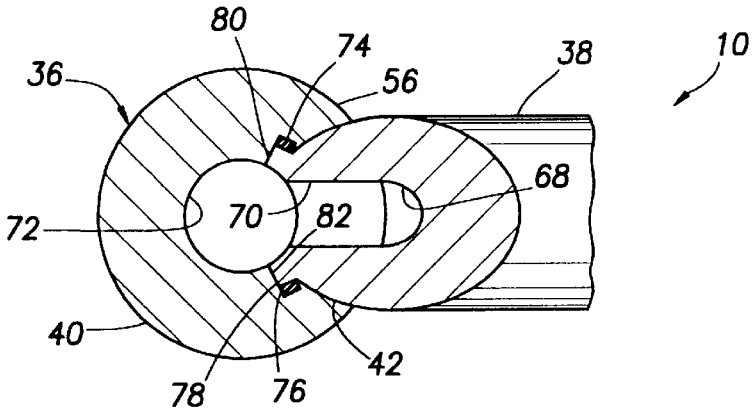
FIGS. 2A–2D are cross-sectional views, taken along line 2—2 of FIG. 1, of alternate methods of sealing the first apparatus.
Figure 2B:
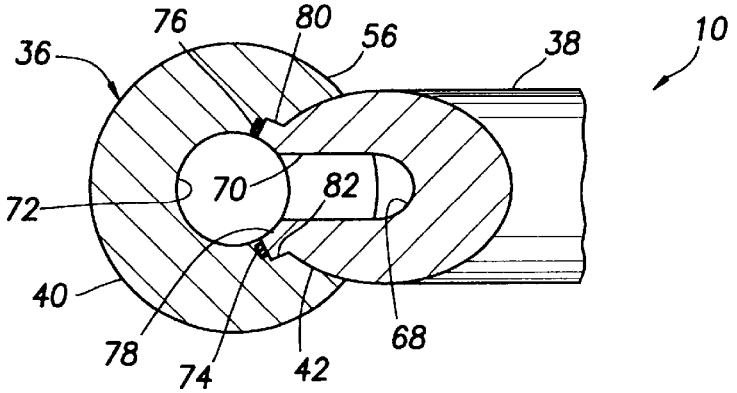

Referring additionally now to FIGS. 2A–2D, alternate positionings of sealing devices between the housings 38, 40 and alternate interlocking profiles are representatively illustrated. In FIG. 2A, a sealing device 74 is carried in a recess 76 formed on the housing 40. The sealing device 74 sealingly engages a circumferentially extending flank 78 of interlocking profiles 80 formed on the housing 38. The sidewall 56 of the housing 40 has profiles 82 complementarily shaped relative to the interlocking profiles 80 internally formed thereon. In FIG. 2B, the interlocking profiles 80, 82 are similarly shaped to those shown in FIG. 2A, but the sealing device 74 sealingly engages a different portion of the profile 80 formed on the housing 38.

Figure 2C:
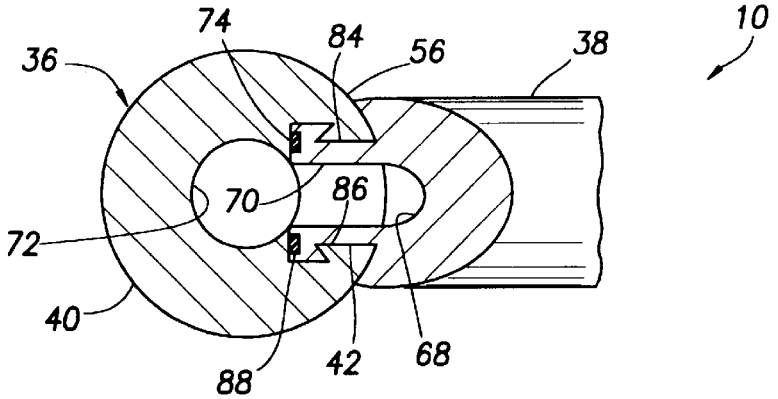

In FIG. 2C, differently shaped interlocking profiles 84, 86 are formed on the housings 38, 40. Additionally, the sealing device 74 is positioned in a recess 88 formed on the end portion 42 adjacent the interlocking profiles 84. Thus, the sealing device 74 may be carried on either housing 38, 40, and the interlocking profiles 84, 86 may be differently shaped, without departing from the principles of the present invention.

Figure 2D:
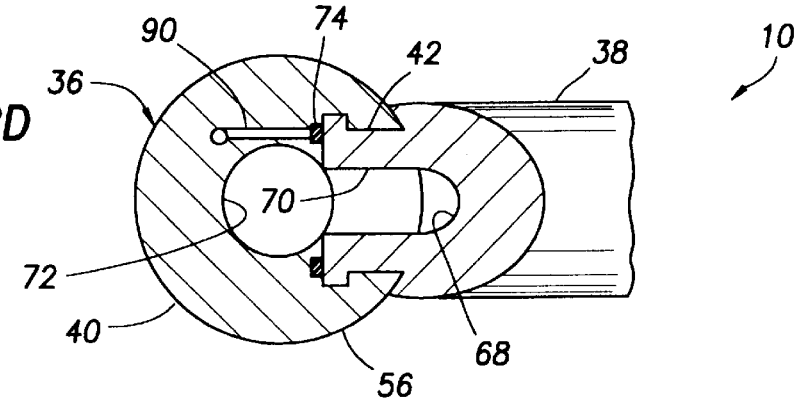

In FIG. 2D, it is seen that the sealing device 74 may be an expandable seal. In particular, the sealing device 74 may be inflatable via a fluid line 90 connected thereto. The fluid line 90 may extend through the housing 40 and to a remote location, such as the earth's surface, as shown in FIG. 1. Alternatively, the sealing device 74 may be expanded or inflated by means of an explosive or propellant device connected thereto. In that case, the line 90 may be an electrical line for use in initiating or detonating the explosive or propellant. Preferably, the sealing device 74 is expanded after the housings 38, 40 are appropriately engaged. Of course, the sealing device 74 may alternatively be an interference-fit type seal, such as an oring.

Figure 3A:
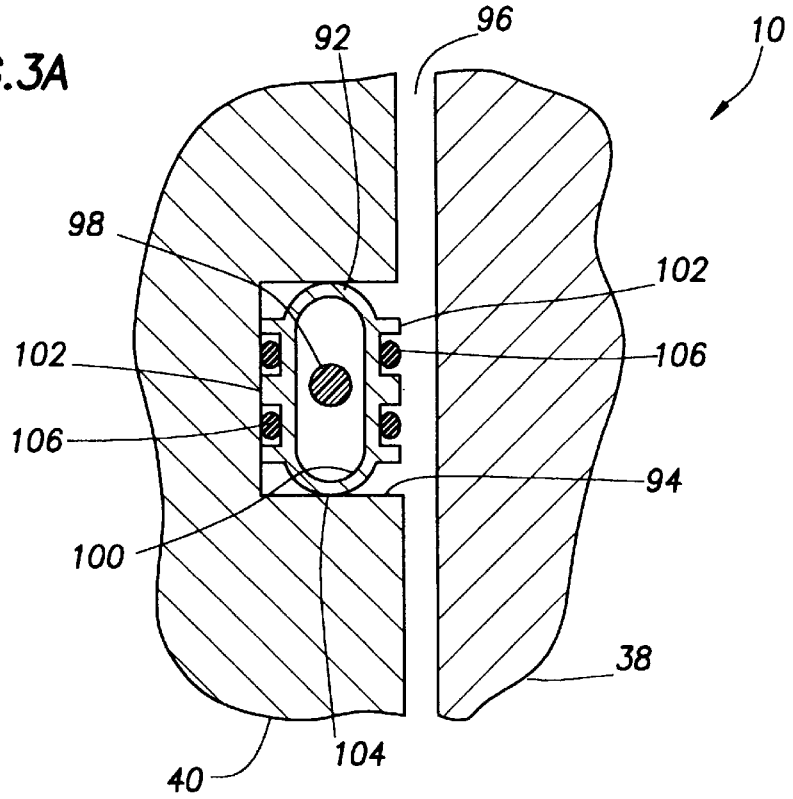
FIGS. 3A & 3B are cross-sectional views of an additional method of sealing the first apparatus.
Figure 3B:
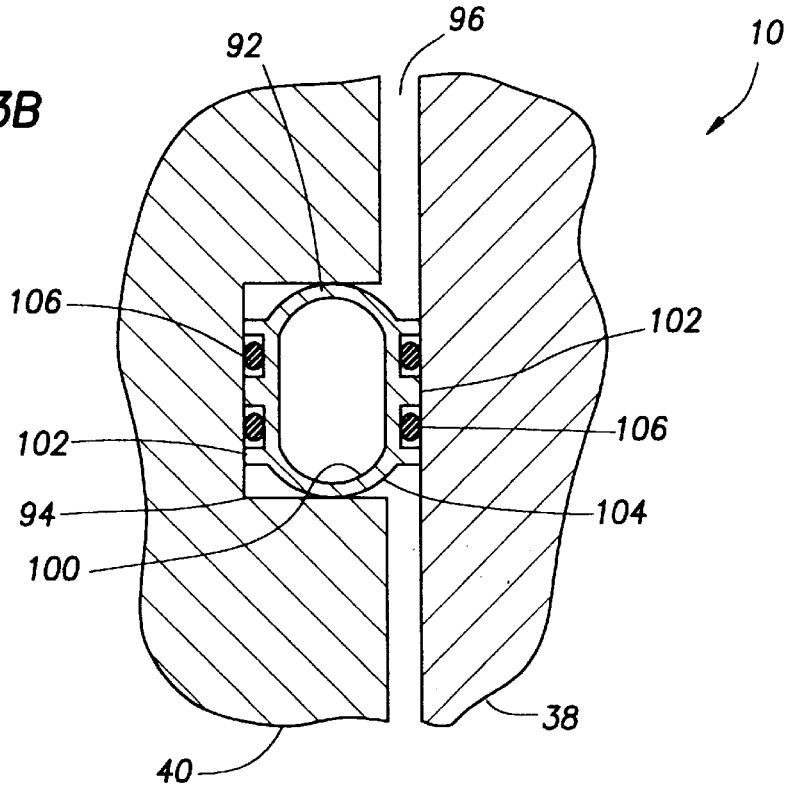

Referring additionally now to FIGS. 3A & 3B, an expandable generally tubular sealing device 92 is representatively illustrated positioned between the housings 38, 40 and disposed in a recess 94 formed on the housing 40. In FIG. 3A, the sealing device 92 is shown in a compressed configuration thereof, in which the sealing device does not sealingly engage both of the housings 38, 40. At this point, the sealing device 92 may sealingly engage one of the housings, such as the housing 40, but it does not sealingly engage the housing 38. Note that a gap 96 exists between the housings 38, 40, which may be due to machining tolerances, clearance to prevent binding between the housings, etc.

A propellant or explosive material 98 may be received within an internal chamber 100 of the sealing device, or may be otherwise connected thereto. Of course, other materials which operate to exert fluid pressure within the internal chamber 100 may also be used, such as a combination of chemicals, etc. Fluid pressure may also be applied to the internal chamber 100, for example, via the line 90.

In FIG. 3B, the sealing device 92 is shown in an extended configuration thereof in which the sealing device sealingly engages both of the housings 38, 40, thereby forming a pressure-bearing seal therebetween. To extend the sealing device 92, the propellant or explosive material 98 has been initiated, detonated, or otherwise actuated to increase fluid pressure within the internal chamber 100. Alternatively, fluid pressure may have been applied to the internal chamber 100 via a fluid conduit, such as the line 90.

Note that external projections 102 formed on the sealing device 92 now abut each of the housings 38, 40. Such engagement between the projections 102 and the housings 38, 40 may form a metal-to-metal seal therebetween if a body portion 104 of the sealing device 92 on which the projections 102 are formed is made of a metallic material. Alternatively, or in addition thereto, the projections 102 may form side walls for retaining seal elements or members 106 carried externally on the body portion 104. The seal elements or members 106 could be elastomeric orings, deposits of metallic material, etc., and, if used, may sealingly engage the housings 38, 40 when the sealing device 92 is expanded across the gap 96, whether or not the projections 102 are also sealingly engaged with either of the housings.

Figure 4A:
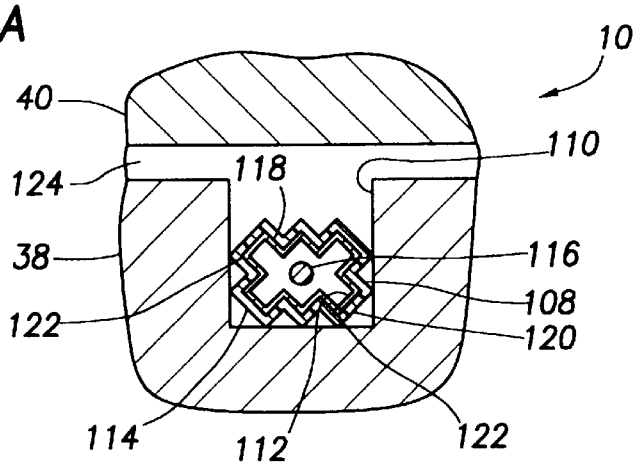
FIGS. 4A–4C are cross-sectional views of another method of sealing the first apparatus.
Figure 4B:
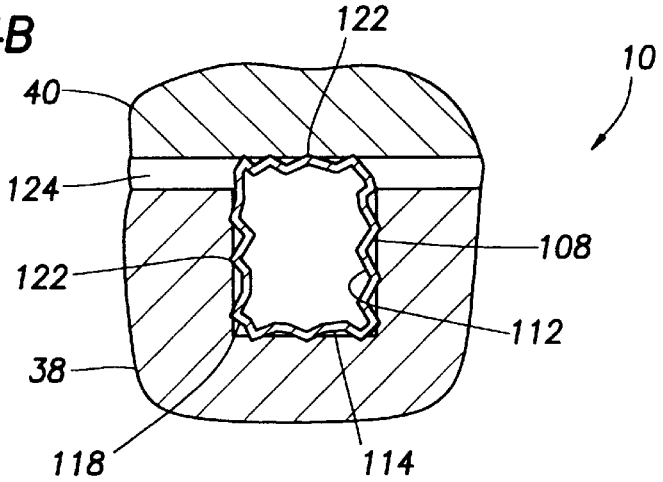
Figure 4C:
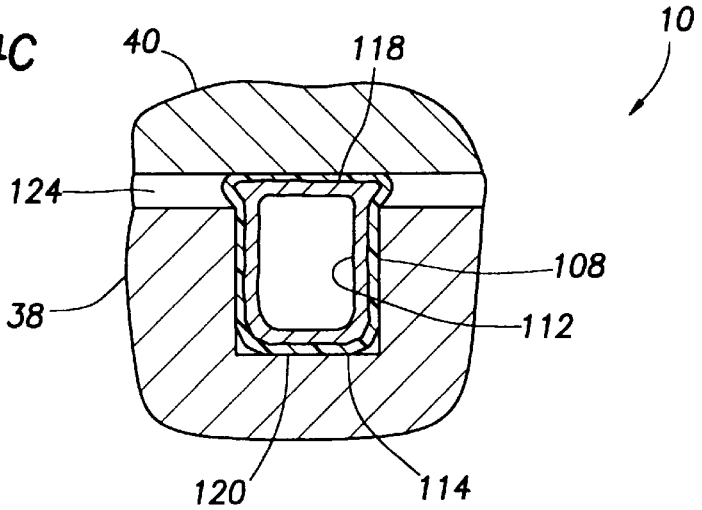

Referring additionally now to FIGS. 4A–4C, alternate forms of another type of expandable sealing device which may be used are representatively illustrated. In FIG. 4A, an expandable generally tubular sealing device 108 is shown in a compressed configuration within a recess 110 formed on the housing 38. The sealing device 108 is in many respects similar to the previously described sealing device 92, for example, the sealing device 108 includes an internal chamber 112, a body portion 114, and an explosive or propellant material 116 disposed in, or otherwise communicated with, the internal chamber. Of course, the sealing device 108 may be inflated or expanded by other means, such as by chemical reaction, application of fluid pressure via a line connected thereto, etc.

The body portion 114 of the sealing device 108 differs significantly from the body portion 104 of the sealing device 92, however, in many respects. The body portion 114 is creased, folded, corrugated, or otherwise has its perimeter compressed, in order to place the sealing device 108 in its compressed configuration. Of course, the body portion 114 could be initially formed in this manner, without the need for subsequently folding, creasing or corrugating it.

In addition, the body portion 114 includes two layers—an inner layer 118 and an outer layer 120. As representatively illustrated, the inner layer 118 is made of a metallic material and the outer layer 120 is made of an elastomeric sealing material. Alternatively, the outer layer 120 could be made of a metallic or other non-elastomeric sealing material, such as a metallic material that is relatively soft as compared to the materials of which the housings 38, 40 are made. However, it is to be clearly understood that the layers 118, 120 made be made of other materials, without departing from the principles of the present invention.

In FIG. 4B, the sealing device 108 is shown in its expanded configuration in which the sealing device sealingly engages each of the housings 38, 40. Such expansion of the sealing device 108 may be accomplished using any of the methods described above for the sealing device 92, or by any other method. The sealing device 108 is shown in FIG. 4B with only one layer 118, thereby demonstrating that the sealing device may have more or less layers than that shown in FIG. 4A. Note that edges 122 of the creases formed on the body portion 114 have become embedded in the housings 38, 40, creating a metal-to-metal seal between the housings. Of course the edges 122 could be projections otherwise formed on the body portion 114.

In FIG. 4C, the sealing device 108 is also shown in its expanded configuration, with the outer layer 120 overlying the inner layer 118 and sealingly engaging each of the housings 38, 40. Note that a metal-to-metal seal may be formed thereby, if the outer layer 120 is made of a metallic material. Additionally, note that one or both of the layers 118, 120 may extrude into a gap between the housings 38, 40 if desired to enhance the sealing ability of the sealing device 108, lock the housings 38, 40 in their positions relative to each other, etc.

Figure 5:
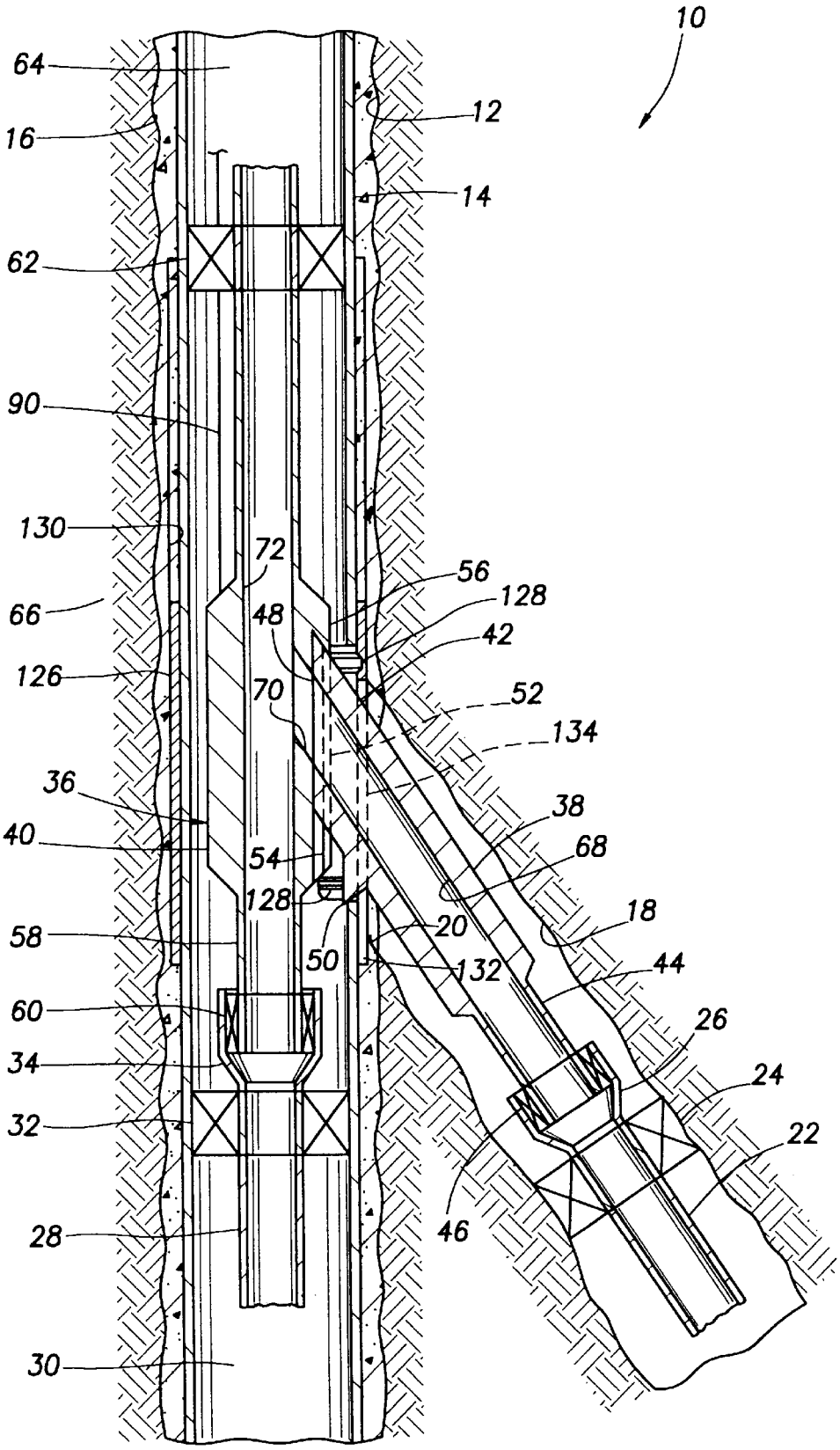
FIG. 5 is a cross-sectional view of a second method and apparatus embodying principles of the present invention.

Referring additionally now to FIG. 5, the method 10 is representatively and schematically illustrated in which additional, optional, steps have been performed. With the housings 38, 40 operatively engaged with each other as shown in FIG. 1, a sleeve 126 disposed externally about the casing 14 is axially downwardly displaced, so that the sleeve engages the housing 38, thereby preventing lateral displacement of the housing 38 relative to the parent wellbore 12 and the wellbore junction. In this manner, the wellbore junction including the housings 38, 40 is stabilized, restricting displacement of the housings and enhancing the sealing engagement therebetween.

For displacing the sleeve 126, one or more latching or shifting profiles 128 may be formed on the sleeve. The profiles 128 may be engaged by a running tool (not shown) used to convey the housing 40 into the parent wellbore 12, so that the sleeve 126 is downwardly shifted into engagement with the housing 38 at the same time as the housing 40 is engaged with the housing 38. Of course, other methods of shifting the sleeve 126 may be utilized without departing from the principles of the present invention.

The sleeve 126 is shifted within a cavity 130 formed exteriorly about the casing 14 adjacent the wellbore junction. The cavity 130 may be formed during the casing cementing operation, or otherwise. For example, a membrane (not shown) having the desired shape of the cavity 130 may be disposed about the casing 14 during the cementing operation, so that a void is formed in the cement.

An axially extending peripheral edge 132 of the sleeve 126 is engaged with the housing 38 when the sleeve is downwardly shifted. The engagement between the edge 132 and the housing 38 may be similar to the manner in which the housings 38, 40 are engaged, that is, by interlocking profiles 134 formed internally on the edge 132 and externally on the housing 38. The interlocking profiles 134 may be similar to those shown in FIGS. 2A–2D, or may be otherwise formed.

Figure 6:
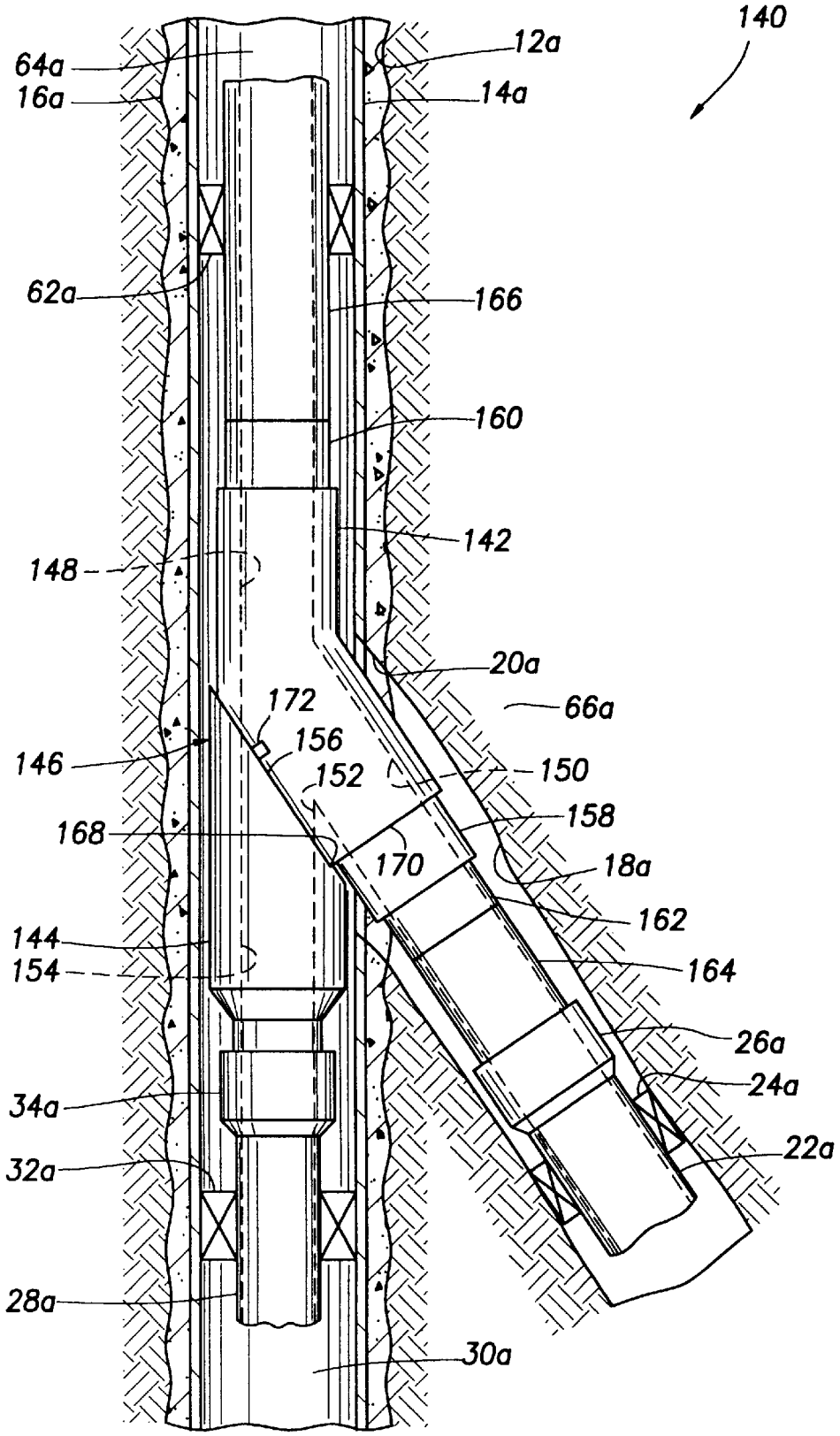
FIG. 6 is a partially elevational and partially cross-sectional view of a third method and apparatus embodying principles of the present invention.

Referring additionally now to FIG. 6, another method 140 of completing a wellbore junction is representatively and schematically illustrated, the method embodying principles of the present invention. Elements of the method 140 shown in FIG. 6 which are similar to those previously described are indicated in FIG. 6 using the same reference numbers, with an added suffix "a".

The method 140 is similar in some respects to the method 10 described above, in that multiple housings 142, 144 are assembled to each other within the well, thereby forming an assembly 146. The assembly 146 provides fluid communication with, and access to, each of the lateral wellbore 18*a*, and the upper and lower parent wellbores 64*a*, 30*a*, via flow passages 148, 150, 152, 154 formed therein. The housings 142, 144 are sealingly and structurally engaged with each other in a manner that is more fully described below. Additionally, the assembly 146 is sealingly disposed in the wellbores 12*a*, 18*a* in a manner preventing migration of fluid between the formation 66*a* intersected by the wellbore junction and other formations intersected by the wellbores.

However, in the method 140, the housing 144 is positioned in the parent wellbore 12*a* relative to the wellbore junction prior to conveying the other housing 142 therein and engaging the housings. This has the benefit of providing a laterally inclined deflection surface 156 at the wellbore junction, so that a lower end 158 of the housing 142, and equipment and tubular members attached thereto, may be conveniently deflected from the parent wellbore 12*a* to the lateral wellbore 18*a*. Additionally, the housing 142 is engaged with the housing 144 by rotational displacement.

With the liner 28*a* sealed within the lower parent wellbore 30*a*, the housing 144 is conveyed into the well and sealingly inserted into the PBR 34*a*. The housing 144 may be conveyed into the well after the lateral wellbore 18*a* has been drilled, or the housing 144 may serve as a deflection device or whipstock for milling the window 20*a* and drilling the lateral wellbore, in which case the housing 144 may be conveyed into the well before the lateral wellbore is drilled. The housing 144 is oriented so that the deflection surface 156 faces toward the lateral wellbore 18*a* using conventional methods, such as by using a gyroscope, orienting nipple attached thereto, etc. The housing 144 is then anchored in position, for example, by setting a packer attached thereto as described above, engaging a profile formed on the PBR 34*a*, or by any other method.

With the housing 144 appropriately positioned as shown in FIG. 6, the liner 22*a* is conveyed into the lateral wellbore 18*a* and sealed therein. The housing 142 and equipment attached thereto are then conveyed into the well. The housing 142 has a flexible coupling 160 attached at an upper end thereof, and a flexible coupling 162 attached at the lower end 158 thereof, to aid in conveying the housing 142 and attached equipment through the upper parent wellbore 64*a* As depicted in the accompanying figures, the housings 142, 144 are enlarged relative to the wellbores 14*a*, 18*a* for clarity of illustration and description, but the housing 142 is preferably dimensioned so that it passes through the casing 14*a*. In addition, the housing 142 has been illustrated (in FIGS. 6 & 7) as if it is bent somewhat, in order to conform the assembly 146 to the confines of the drawing and the dimensions of the illustrated wellbores 12*a*, 18*a*, but preferably the housing has a generally linear shape in actual practice. It is to be clearly understood that it is not necessary for either or both of the flexible couplings 160, 162 to be used in the method 140.

Attached to the flexible coupling 162 is a tubular member 164, which is sealingly inserted into the PBR 26*a* Another tubular member 166 and the packer 62*a* or other sealing device are attached above the flexible coupling 160.

As the housing 142 is inserted into the lateral wellbore 18*a*, an external projection, abutment portion or shoulder 168 formed on the deflection surface 156 engages a circumferentially extending abutment portion or shoulder 170 formed on the housing 142, thereby preventing further displacement of the housing 142 relative to the housing 144. At this point, the housings 142, 144 are in position to be rotationally interlocked. The housing 142 is then rotated relative to the housing 144, for example, by rotating at the earth's surface a work string to which the housing 142 is attached, and the housings are rotationally interlocked with each other. Note that the shoulders 168, 170 remain engaged during this operation.

A stop member 172 attached externally to the housing 142 prevents rotation of the housing 142 past a position in which the flow passages 152, 154 are aligned. The packer 62*a* is then set in the casing 14*a*, anchoring the housing 142 in the position shown in FIG. 6. The housings 142, 144 are, thus, secured to each other and the assembly 146 is sealed within the lateral wellbore 18*a*, and the upper and lower parent wellbores 64*a*, 30*a*.

Figure 7:
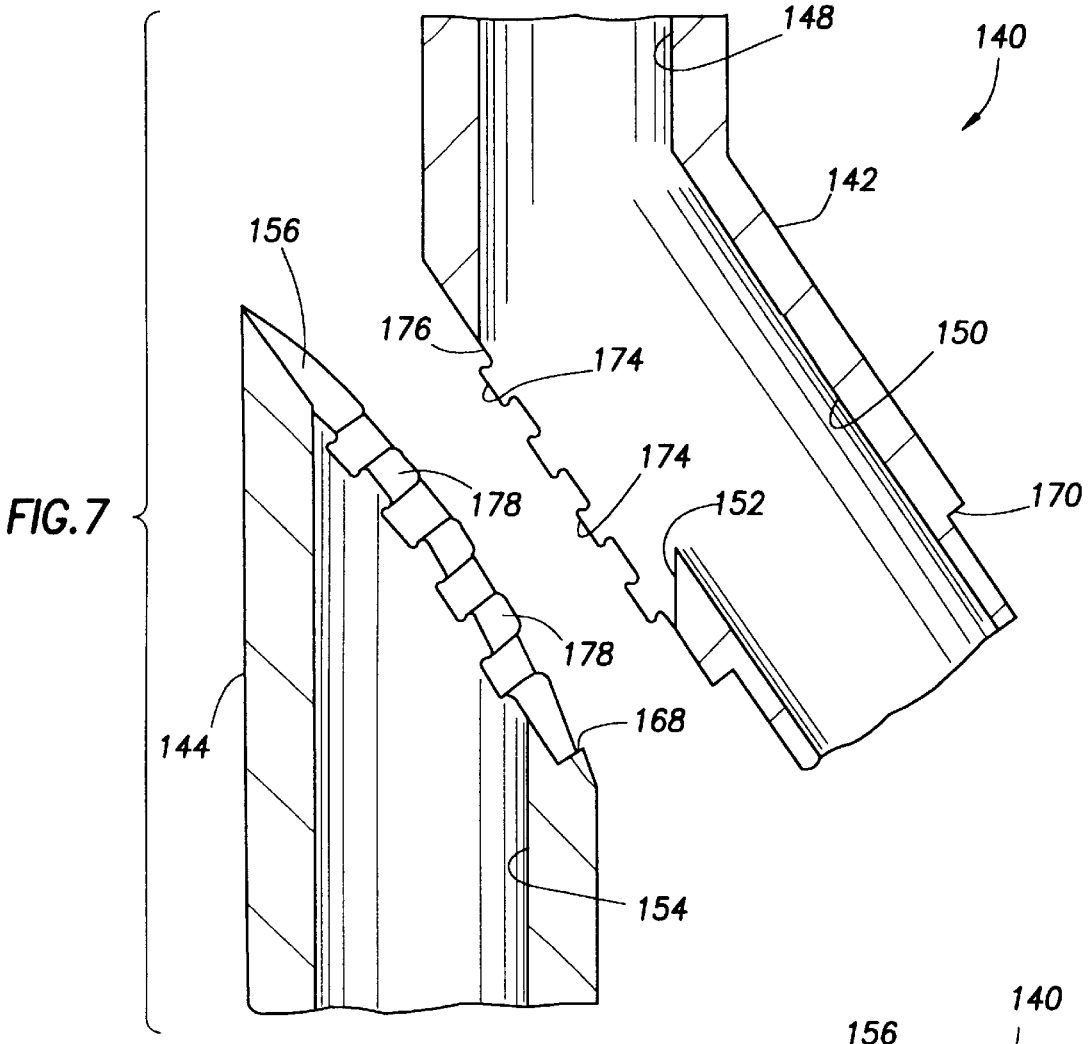
FIG. 7 is an enlarged cross-sectional view of portions of the third apparatus, showing an alternate configuration thereof.

For details of a manner in which the housings 142, 144 may be rotationally interlocked, additional reference may now be made to FIG. 7, in which the housings 142, 144 are representatively depicted in cross-section and separated from each other. In FIG. 7 it may be clearly seen that the housing 142 has a series of interlocking profiles 174 formed externally and laterally across a circumferentially extending sidewall 176 of the housing 142 through which the flow passage 152 extends. The profiles 174 extend circumferentially as well.

Figure 8:
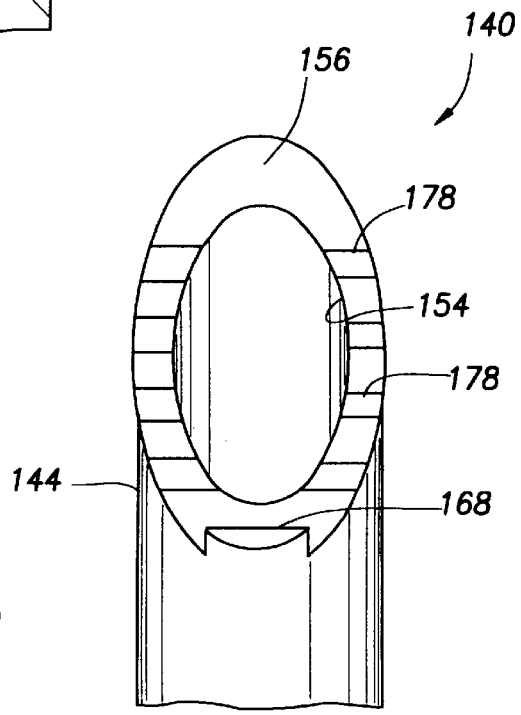
FIGS. 8–11 are elevational views of portions of the third apparatus, showing alternate configurations thereof.

The housing 144 has a complementarily shaped series of interlocking profiles 178 formed on the upper end thereof, which is complementarily concave-shaped for receiving the sidewall 176 therein. As shown in FIG. 7, the profiles 174, 178 are dovetail-shaped, but it is to be clearly understood that other shapes may be utilized without departing from the principles of the present invention. Representatively shown in FIG. 8 is a side view of the upper end of the housing 144, showing one manner in which the profiles 178 may extend laterally across the upper end. For clarity of illustration, the housing 144 upper end is shown in FIG. 8 as if it is flat, however, it is preferred that the upper end be concave as described above.

Figure 9:
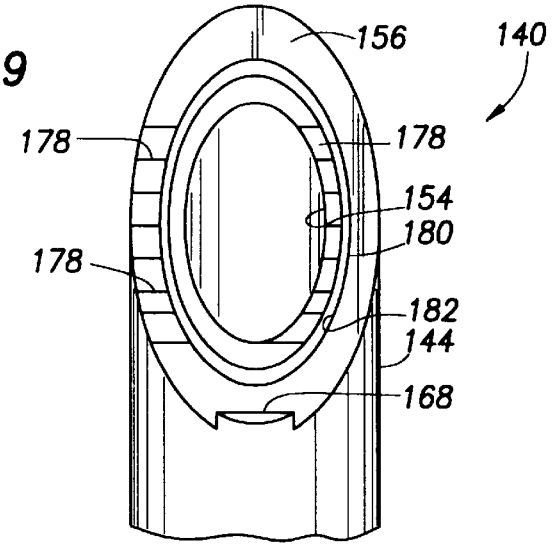
Figure 10:
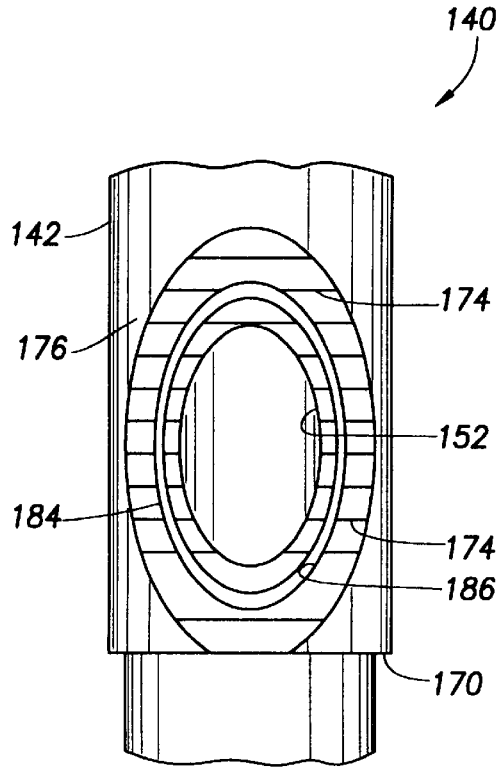
Figure 11:
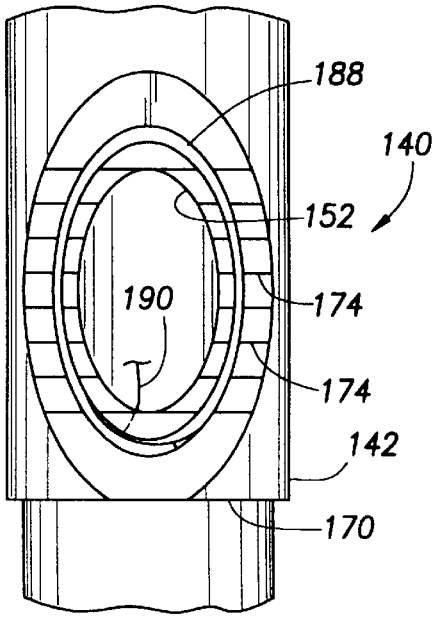

Referring additionally now to FIGS. 9–11, alternative methods of sealing between the housings 142, 144 are representatively illustrated. In FIG. 9, it may be seen that a sealing device 180 is carried on the housing 144 upper end, such as in a recess 182 formed thereon. The sealing device 180 may be any of those described above, or any other type of sealing device, including those described below, an interference-fit type seal, etc. When the housing 144 is rotationally interlocked with the housing 142 as shown in FIG. 6, the sealing device 180 sealingly engages the sidewall 176.

Additionally, FIG. 9 shows an alternate manner of forming the profiles 178 on the housing 144, wherein the profiles extend only partially across the housing upper end, so that the profiles do not extend across the sealing device 180. The housing 142 correspondingly has the profiles 174 extending only partially across the sidewall 176.

In FIG. 10, a sealing device 184 is carried in a recess 186 formed on the sidewall 176. Note that one or more of the profiles 174 may be formed above and/or below the recess 186 as shown in FIG. 10. In FIG. 11, an expandable sealing device 188 is utilized on the housing 142. The sealing device 188 may be similar to those expandable sealing devices described above, or it may be a different type of sealing device, such as those described below. For example, the sealing device 188 may be inflated via a line 190 connected thereto.

Referring additionally now to FIGS. 12A & 12B, a sealing device 192 is representatively illustrated in compressed and expanded configurations thereof. The sealing device 192 may be used for the sealing devices 180, 184, 188 described above. In FIG. 12A, the sealing device 192 is depicted in its compressed configuration and installed in a recess 194. A profile 196 is formed intersecting the recess 194.

The sealing device 192 includes a generally tubular body portion 198, a sealing material 200 attached externally to the body portion, and a propellant or explosive material 202 disposed in an internal cavity 204. The body portion 198 is preferably made of a metallic material. The sealing material 200 is preferably an elastomer. However, other materials may be used for the body portion 198 and sealing material 200 without departing from the principles of the present invention. Additionally, the propellant or explosive material 202 may be otherwise connected to, or placed in communication with, the internal cavity 204, and the material 202 may be other material capable of producing fluid pressure within the internal cavity. Furthermore, the propellant or explosive material 202 is not necessary, since fluid pressure may be otherwise applied to the internal cavity 204, such as via a fluid line connected thereto as described above.

In FIG. 12B, the sealing device 192 is shown in its expanded configuration after fluid pressure has been applied to the internal cavity 204. Prior to expanding the sealing device 192, however, an interlocking profile 206 has been engaged with the profile 196, so that the profile 206 now extends laterally across the recess 194. A similar arrangement of sealing device, recess, and interlocked profiles may occur when the housing 142 as shown in FIG. 11 is rotationally engaged with the housing 144 as described above.

With the profile 206 extending across the recess 194, the sealing device 192 is expanded or inflated. This causes the sealing material 200 to be forced upwardly as shown in FIG. 12B, sealingly engaging the profile 206 and conforming complementarily thereto. The body portion 198 may form a metal-to-metal seal in the recess 194. In this manner, the housings 142, 144 may be sealingly engaged, even though the profiles 174, 178 extend across a recess in which a sealing device is disposed.

Referring additionally now to FIG. 13, another method of sealingly engaging the housings 142, 144 is representatively illustrated. In FIG. 13, it may be seen that a sealing material 208, such as an elastomer, a relatively soft metallic material, etc., is disposed between the profiles 174, 178 and is complementarily shaped relative thereto. The sealing material 208 may be attached, bonded, molded, etc. to either of the housings 142, 144, or separate sealing materials may be applied to both of the housings, so that when the profiles 174, 178 are engaged, the sealing materials sealingly engage each other.

Referring additionally now to FIG. 14, another sealing device 210 is representatively illustrated. The sealing device 210 has a body portion 212, which may be made of a relatively soft metallic material, or other material that may be outwardly deformed as described below. An optional lower portion 216 of the body portion 212 is shown in FIG. 14 in dashed lines.

The body portion 212 has a recess or internal cavity 214 formed thereon or therein. If the lower portion 216 is provided, then the body portion 212 has the internal cavity 214 formed therein and the body portion is generally tubular. However, if the lower portion 216 is not provided, the body portion has the recess 214 formed thereon. In that case, when the sealing device 210 is installed in a recess, such as the recesses 182, 186, 194, the recess 214 formed on the body portion 212 will effectively form an internal cavity.

The body portion 212 also has profiles 218 formed thereon complementarily shaped relative to one of the profiles 174, 178 formed on the housings 142, 144. It will, thus, be readily appreciated that the sealing device 210 may be disposed in a recess across which the profiles 174, 178 extend when the housings 142, 144 are rotationally interlocked, with the profiles 218 of the sealing device complementarily engaged with one of the profiles 174, 178. The sealing device 210 may then be expanded or inflated, for example, by applying fluid pressure to the internal cavity or recess 214 or initiating or detonating a propellant or explosive material 220 disposed therein or otherwise in communication therewith, to thereby force the body portion 212 into sealing contact with the interlocked profiles 174, 178 and sealing engagement between the housings 142,144.

Referring additionally now to FIG. 15, an alternate configuration of the housing 144 is shown and is indicated by reference number 222. In a method utilizing the housing 222, a corresponding housing similar to the housing 142 is sealingly engaged with the housing 222, without rotationally interlocking the housings as in the method 140. Thus, the interlocking profiles 174, 178 are not formed on the housings. Instead, the housing 142 is engaged with the housing 222 in place of the housing 144 shown in FIG. 6, and a projection 224 formed on an upper laterally inclined surface 226 of the housing 222 engages a complementarily shaped recess (not shown) formed on the housing 142. Of course, the projection 224 could be formed on the sidewall of the housing 142 and a complementarily shaped recess formed on the housing 222, and the housings could be rotationally interlocked, without departing from the principles of the present invention.

This engagement of the housings 142, 222 is substantially similar to that shown in FIG. 6, with the exception that the housing 222 is substituted for the housing 144, and the shoulder 170 of the housing 142 is replaced with a recess complementarily shaped relative to the projection 224. Note that the projection 224 has angular flanks, with an apex thereof aligned with a longitudinal axis of a flow passage 228 formed axially through the housing 222. In this manner, the projection 224 may be utilized to rotationally align and secure the housing 142 with respect to the housing 222, so that the flow passages 152, 228 are aligned.

Engagement between the housings 142, 222 may be maintained by an axially downwardly biasing force applied to the housing 142 by the packer 62*a*. Sealing engagement may be provided by a sealing device 230, such as an oring or any of the other sealing devices described herein, carried on the housing 222, or carried on the housing 142. Note that, since the housings 142, 222 are not necessarily rotated into sealing engagement with each other, the deflection surface 226 and sidewall 176 may be essentially flat if desired.

Figure 18:
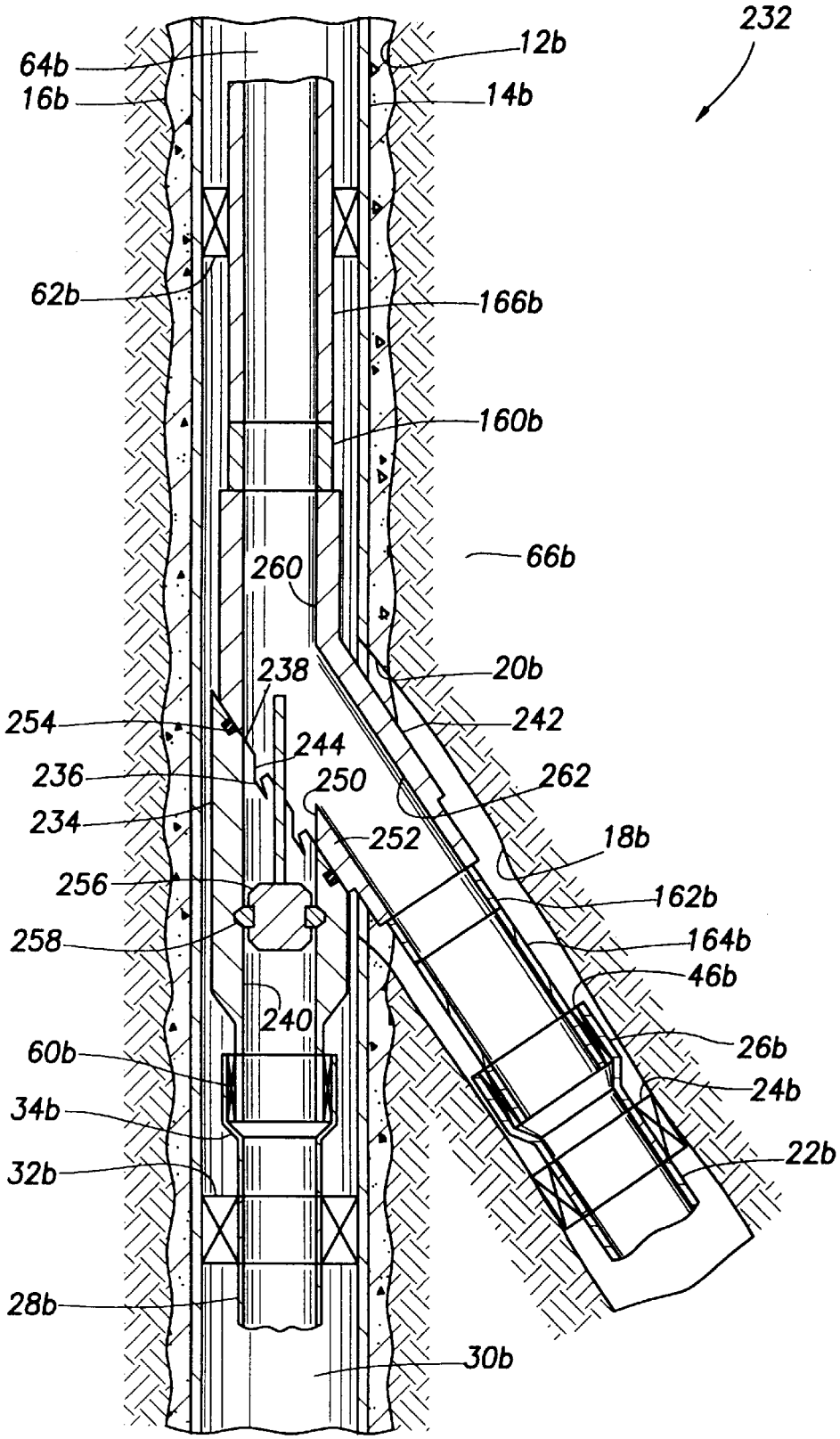
FIG. 18 is a cross-sectional view of the fifth method and apparatus.

Referring additionally now to FIGS. 16–18, another method 232 of completing a wellbore junction is representatively and schematically illustrated. Elements shown in FIG. 18 which are similar to those previously described are indicated using the same reference numbers, with an added suffix "b". The method 232 is in some respects similar to the method 140 as modified by substitution of the housing 222 for the housing 144 as described above. However, instead of utilizing a projection 224 having angular flanks, a housing 234 is provided which includes a series of generally V- or chevron-shaped interlocking profiles 236 formed thereon.

As shown in FIG. 16, the profiles 236 may be distributed across an upper laterally inclined surface 238 formed on the housing 234, so that apexes 138 of the profiles are aligned with an axial flow passage 240 formed through the housing. The dashed lines in FIG. 16 indicate that, even though some or all of the profiles 236 may only be partially formed on the housing 234, their apexes 138 may still be aligned with the flow passage 240. The profiles 236 may be equally spaced, or the spacings therebetween may vary as shown in FIG. 16. For example, an adjoining pair of the profiles 236 may have a distance therebetween that is different from the distance between another adjoining pair of the profiles. Additionally, the profiles 236 may all have the same angular separation between flanks thereof, or the angular separations may vary among the profiles as shown in FIG. 16. By varying the distances between the profiles 236, varying the angular separations between the flanks, or otherwise varying the configurations of the profiles 236, engagement between the housing 234 and a complementarily shaped housing 242 may be prevented until the housings are appropriately aligned.

Referring now to FIG. 17, an enlarged cross-section is shown of the housings 234, 242 engaged with each other. The housing 242 has an at least partially complementarily shaped profile 244 formed thereon relative to the profile 236 and engaged therewith. To prevent, or at least hinder, disengagement of the profiles 236, 244, the profiles may be configured so that a face 246 formed on the profile 236, and a face 248 formed on the profile 244 are engaged, and the faces are disposed at an angle "A" relative to the surface 238 that is equal to or less than a friction angle of the materials of which the housings 234, 242 are made or of the surfaces of the faces 246, 248. In this manner, the profiles 236, 244, upon being forcefully engaged, will not readily disengage.

Referring now to FIG. 18, the housing 234 is shown engaged with the housing 242, the profiles 236, 244 being interlocked by displacing the housing 242 downwardly and laterally across the upper surface 238 of the housing 234, until the profiles engage. As described above the profiles 238, 244 may be configured to permit engagement only when the housing 242 is appropriately positioned with respect to the housing 234. When appropriately positioned, the flow passage 240 is aligned with a flow passage 250 formed through a sidewall 252 of the housing 242.

A sealing device 254 may be carried on the housing 234 for sealing engagement with the sidewall 252. The sealing device 254 may be any of the sealing devices described above, or may be any other type of sealing device, such as an interference-fit type seal.

A biasing force may be applied to urge the housing 242 downwardly toward engagement with the housing 234 by a latching tool 256 latched in a profile 258 formed internally in the housing 234. The latching tool 256 may form a portion of a running tool (not shown) used to convey the housing 242 and associated equipment into the well. When the profiles 236, 244 are engaged with each other, an upwardly directed biasing force may be applied to the latching tool 256 to thereby apply an oppositely directed biasing force to the housing 242. Additionally, or alternatively, the packer 62*b* may exert a downwardly biasing force to the housing 242 when it is set in the casing 14*b*, and if the sealing device 46*b* is a packer, it may exert a downwardly biasing force on the housing 242 when it is set in the PBR 26*b*.

Note that the flow passage 250 intersects flow passages 260, 262 formed in the housing 242. The flow passage 260 extends upwardly for fluid communication through the upper parent wellbore 64*b*. The flow passage 262 extends downwardly and laterally for fluid communication through the lateral wellbore 18*b*.

Figure 19:
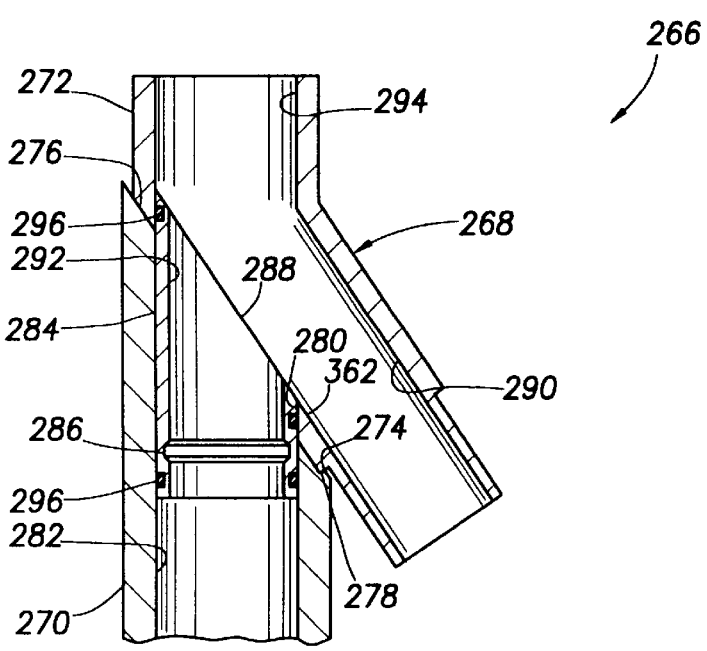
FIG. 19 is a cross-sectional view of a sixth method and apparatus embodying principles of the present invention.

Referring additionally now to FIG. 19, another method of completing a wellbore junction embodying principles of the present invention is representatively and schematically illustrated. In FIG. 19, an assembly 268 including two housings 270, 272, and a sleeve 284 sealingly engaging each of the housings, is shown. This assembly 268 may be substituted for the assembly 146 shown in FIG. 6. Otherwise, the method 266 is in many respects substantially similar to the method 140 described above and representatively illustrated in FIG. 6.

However, in the method 266, the housings 270, 272 are not rotationally interlocked with each other. Instead, when the housing 272 is conveyed into the well (the housing 270 having been previously positioned in the parent wellbore 12 relative to the wellbore junction), a shoulder or projection 274 formed on an upper laterally inclined end surface 276 is engaged with a shoulder or projection 278 formed on the housing 272. The projection 274 may be shaped similar to the projection 224 shown in FIG. 15 in order to rotationally align the housings 270, 272, a corresponding complementarily shaped recess being formed on the housing 272 in place of the shoulder 278, although other shapes may be utilized as well. Such engagement between the housings 270, 272 aligns a flow passage 280 formed in the housing 272 with a flow passage 282 formed axially through the housing 270.

Preferably, the housing 272 is then biased downwardly toward engagement with the housing 270 by setting the packer 62 in the casing 14, the packer being directly or indirectly attached to the housing 272. Of course, other methods of maintaining engagement of the housings 270, 272 may be utilized, such as by applying all or a portion of the weight of a tubular string attached above the housing 272 to the housing 272.

The sleeve 284 is then shifted to the position shown in FIG. 19, thereby forming a pressure-bearing seal between the flow passages 280, 282 or, stated differently, sealingly engaging each of the housings 270, 272 across the interface therebetween. The sleeve 284 may initially be positioned within the housing 270, within the housing 272, separately conveyed into the well, etc., or otherwise positioned prior to being shifted to the position shown in FIG. 19. However, in this embodiment of the present invention, it is preferred for the sleeve 284 to be initially disposed within the flow passage 282 of the housing 270. An annular profile or recess 286 is formed internally on the sleeve 284 for engagement with a conventional shifting tool (not shown) for shifting the sleeve. However, it is to be clearly understood that the sleeve 284 may be otherwise displaced, such as by fluid pressure applied thereto, etc., without departing from the principles of the present invention.

Note that, in the position of the sleeve 284 shown in FIG. 19, an upper laterally inclined end surface 288 of the sleeve is aligned with a flow passage 290 formed in the housing 272 and intersecting the flow passage 280. The upper surface 288 may be utilized to deflect equipment, tools, etc. into the flow passage 290 and thence into the lateral wellbore 18. For example, an internal axial bore 292 of the sleeve 284, which provides fluid communication between the flow passages 280, 282, may have a diameter smaller than that of the flow passage 290, so that equipment having a diameter larger than the bore 292 and conveyed downwardly through another intersecting flow passage 294 formed in the housing 272 will not pass through the bore 292, but will be deflected off of the surface 288 and into the flow passage 290. Thus, the sleeve 284 may function as a size-selective diverter within the assembly 268.

Circumferential seals, such as orings 296 are axially spaced apart and carried externally on the sleeve 284 for sealing engagement with the housings 270, 272 as shown in FIG. 19. However, it will be readily appreciated that other seals, other types of seals, other positionings of seals, etc., may be used to sealingly engage the sleeve 284 with the housings 270, 272. Additionally, engagement of the sleeve 284 with each of the housings 270, 272 may be utilized to maintain alignment between the housings 270, 272, strengthen the resistance to fluid pressure applied externally and/or internally to the assembly 268, etc. For example, in FIG. 19, note that the sleeve 284, being received in both of the flow passages 280, 282, acts to prevent misalignment therebetween.

Figure 20:
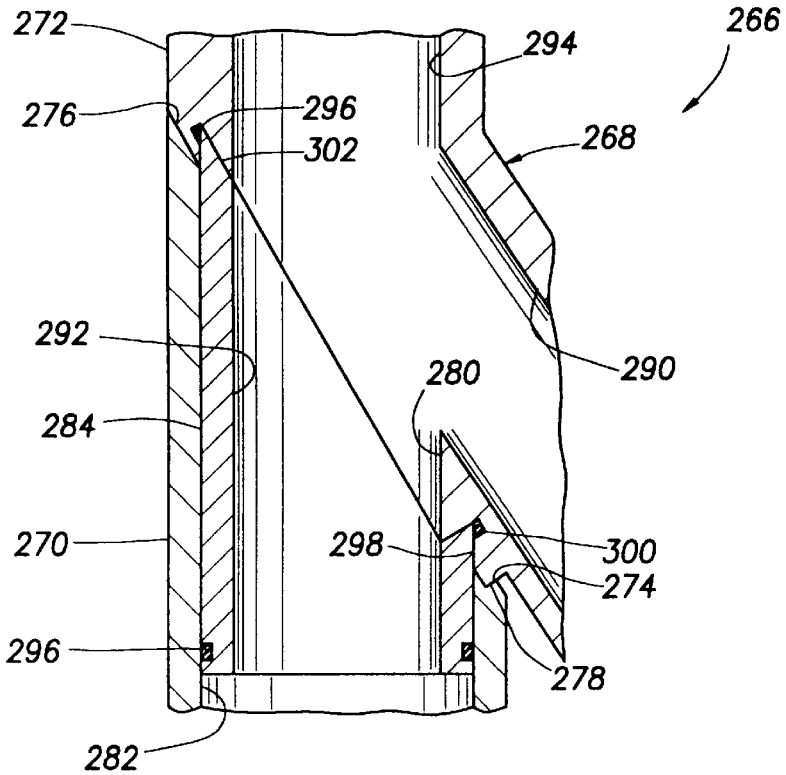
FIG. 20 is a cross-sectional view of an alternate configuration of the sixth apparatus.

Referring additionally now to FIGS. 20–28, alternate configurations of the assembly 268 are representatively illustrated, showing alternate methods of sealingly engaging and positioning the sleeve 284 with respect to the housings 270, 272 in the method 266. In FIG. 20, the sleeve 284 is upwardly shifted into engagement with a radially enlarged and laterally inclined portion 298 of the flow passage 280. The portion 298 forms an enlarged bore or radially enlarged recess on the flow passage 280. The sleeve 284 is sealingly engaged with one of the seals 296 carried on the housing 272 in a recess 300 formed adjacent the enlarged bore 298. Thus, the seals 296 may be carried on the sleeve 284, or on either of the housings 270, 272.

The sleeve 284 has a profile or an inwardly beveled and laterally inclined upper end surface 302 which is complementarily received in the housing 272 adjacent the enlarged bore 298. It will be readily appreciated that, if fluid pressure is applied externally to the assembly 268, the sleeve 284 will be inwardly biased by the pressure acting between the seals 296. Contact between the surface 302 and the housing 272 acts to restrict inward displacement of the sleeve 284, thereby increasing its resistance to pressure-induced collapse. The beveled surface 302 may also be utilized to correct misalignment between the housings 270, 272 when the sleeve 284 is upwardly shifted into contact with the housing 272, the beveled surface tending to center the flow passage 280 relative to the flow passage 292.

Figure 21A:
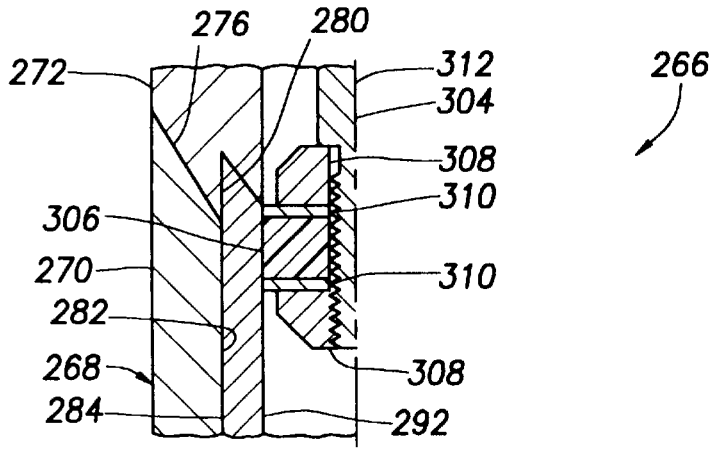
FIGS. 21A–21C are cross-sectional views of the sixth apparatus, showing alternate methods of sealing the apparatus.

In FIG. 21A, a method of sealingly engaging the sleeve 284 is shown, in which a metal-to-metal seal is formed between the sleeve and at least one of the housings 270, 272. In the method shown in FIG. 21A, the sleeve 284 is deformed radially outward into sealing contact with each of the housings 270, 272 across the interface therebetween. For this purpose, an expander tool 304 is inserted into the sleeve 284 and operated to radially outwardly extend an annular elastomeric member 306 by axially compressing the elastomeric member between relatively inflexible clamp members 308 and washers 310. For example, a threaded mandrel or rod 312 may be threaded into one of the clamp members 308 and rotated to axially displace the threaded clamp member toward the other clamp member.

The expander tool 304 may be a part of an overall running tool (not shown) used to convey the housing 272 into the well, or the tool 304 may be separately utilized. Note that the sleeve 284 may be deformed into sealing metal-to-metal contact with only one or both of the housings 270, 272, and may be sealingly engaged with one or both of the housings utilizing a sealing device. For example, an upper end of the sleeve 284 may be deformed into sealing metal-to-metal contact with the upper housing 272, but a lower end of the sleeve may be sealingly received in the lower housing 270 using a sealing device, such as an oring.

Figure 21B:
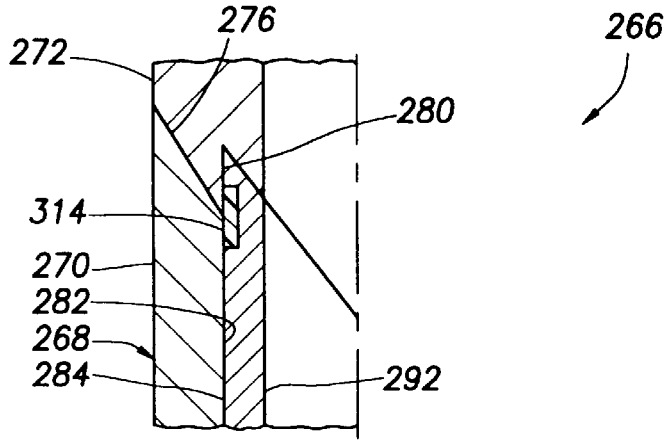

In FIG. 21B, it may be seen that it is not necessary for multiple seals 296 to be used in the assembly 268. A seal element or sealing device 314 may be positioned so that it straddles the interface between the housings 270, 272, providing sealing engagement therebetween. As shown in FIG. 21B, the seal element 314 is carried externally on the sleeve 284 and is made of an elastomeric material. However, it is to be clearly understood that the seal element may be otherwise positioned, and may be made of other sealing materials, without departing from the principles of the present invention.

In addition, it is not necessary for a sealing device, such as the sealing device 314 carried on the sleeve 284 to extend radially outward from the sleeve when the sleeve is shifted into engagement with the housing 272. For example, the sealing device 314 could be radially inwardly recessed relative to the outer surface of the sleeve 284 when the sleeve is upwardly shifted into engagement with the upper housing 272, for ease of shifting the sleeve and to prevent damage to the sealing device. After the sleeve 284 has been upwardly shifted, a tool, such as the expander tool 304 described above, may then be inserted into the sleeve with the elastomeric element 306 positioned radially opposite the sealing device 314. The expander tool 304 may then be operated to radially outwardly deform the sleeve 284 as described above, thereby outwardly bowing the sleeve where it radially underlies the sealing device 314, and causing the sealing device to be radially outwardly extended into sealing engagement with the housing 272.

Figure 21C:
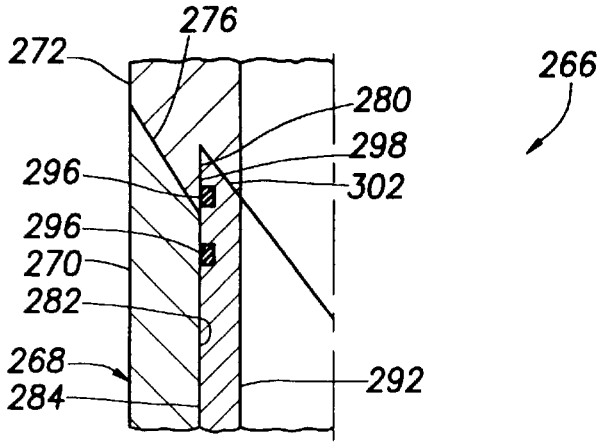

In FIG. 21C, the seals 296 are shown utilized on the sleeve 284 in combination with the inwardly beveled end surface 302, an upper one of the seals being sealingly engaged with the enlarged bore 298 of the flow passage 280. Thus, it may be seen that various features of the alternate configurations described herein may be combined with others of the features as desired, without departing from the principles of the present invention. One or both of the seals 296 may be radially outwardly extended into sealing engagement with the housing 272 and/or the housing 270 as described above for the sealing device 314. That is, one or both of the seals 296 may be initially radially inwardly recessed relative to the outer side surface of the sleeve 284 and then radially outwardly extended after the sleeve has been shifted upwardly into engagement with the housing 272.

Figure 22:
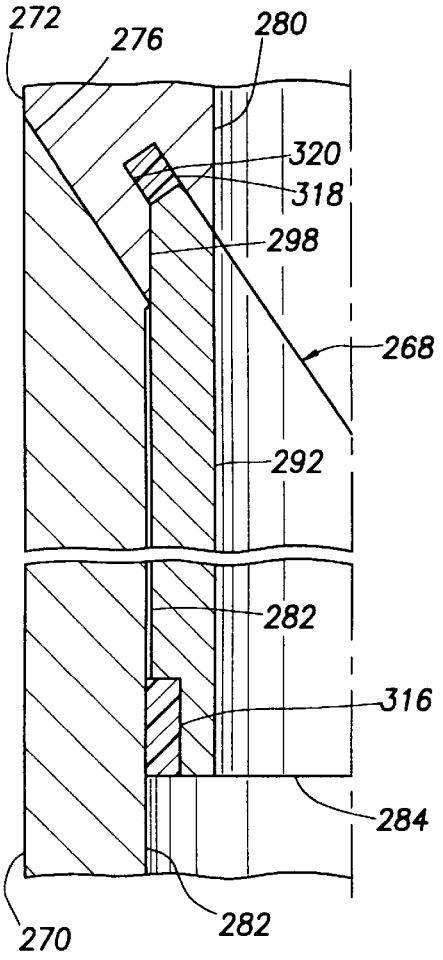
FIGS. 22–26 are cross-sectional views of the sixth apparatus, showing alternate configurations thereof and alternate methods of sealing the apparatus.

In FIG. 22, an annular seal element or seal member 316 is carried externally on the sleeve 284 at a lower end thereof for sealing engagement with the flow passage 282 within the housing 270. Another seal element or seal member 318 is carried internally on the upper housing 272 adjacent the enlarged bore 298 in a laterally inclined recess 320 for sealing engagement with the laterally inclined upper end of the sleeve 284. The seal element 316 may be adhesively bonded to the sleeve 284, molded thereon, applied thereto, etc. In a similar manner, the seal 318 may be molded within the recess 320, applied therein, adhesively bonded therein, etc. Of course, the seals 316, 318 may be otherwise positioned, otherwise attached, and made of other materials, without departing from the principles of the present invention.

Figure 23:
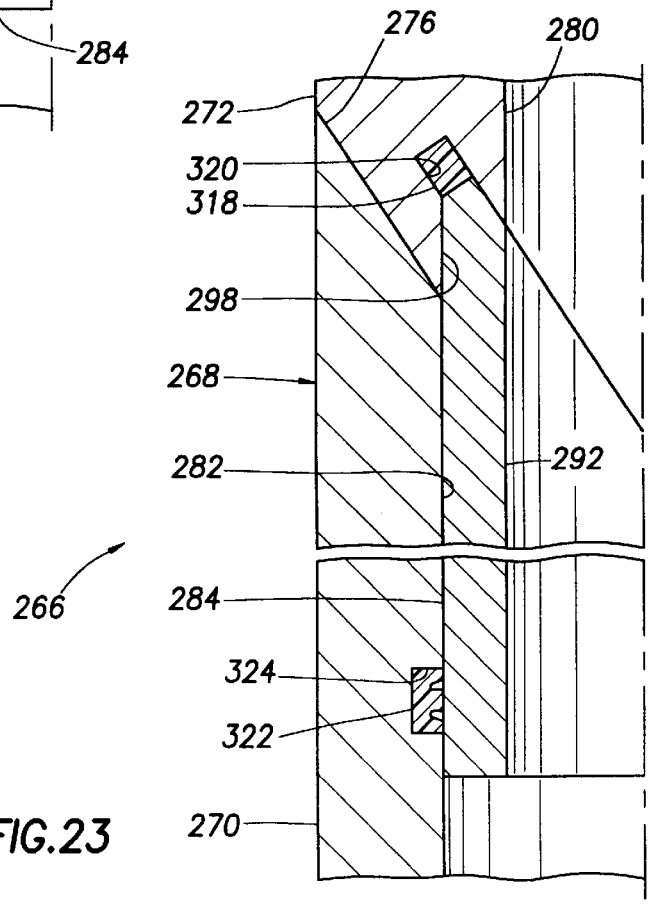

In FIG. 23, a sealing device or seal element 322 is carried internally on the lower housing 270 in an annular recess 324 formed therein. The seal element 322 sealingly engages an outer side surface of the sleeve 284. The upper end of the sleeve 284 is sealingly received in the upper housing 272 in a manner similar to that shown in FIG. 22.

Figure 24:
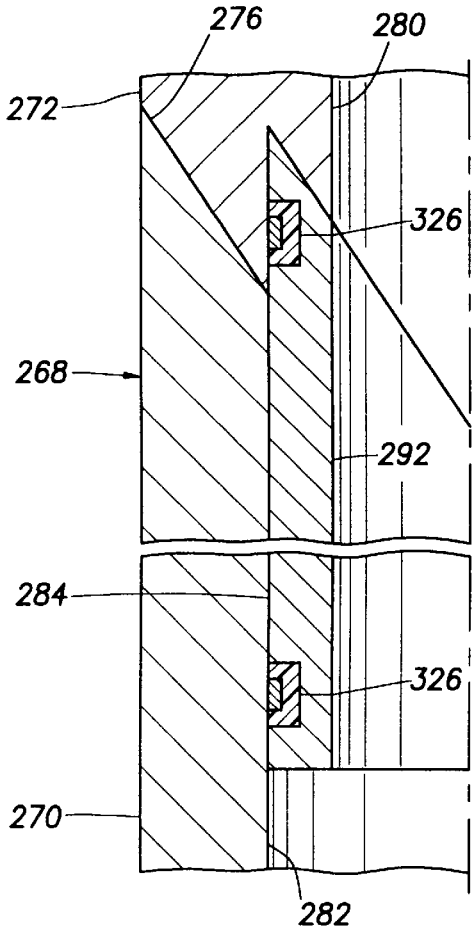

In FIG. 24, another type of sealing device 326 is carried on the sleeve 284. The sealing device 326 may include both elastomeric and non-elastomeric portions as shown in FIG. 24. Two of the sealing devices 326 are utilized, axially separated on the sleeve 284.

Figure 25:
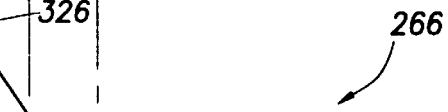
Figure 25:
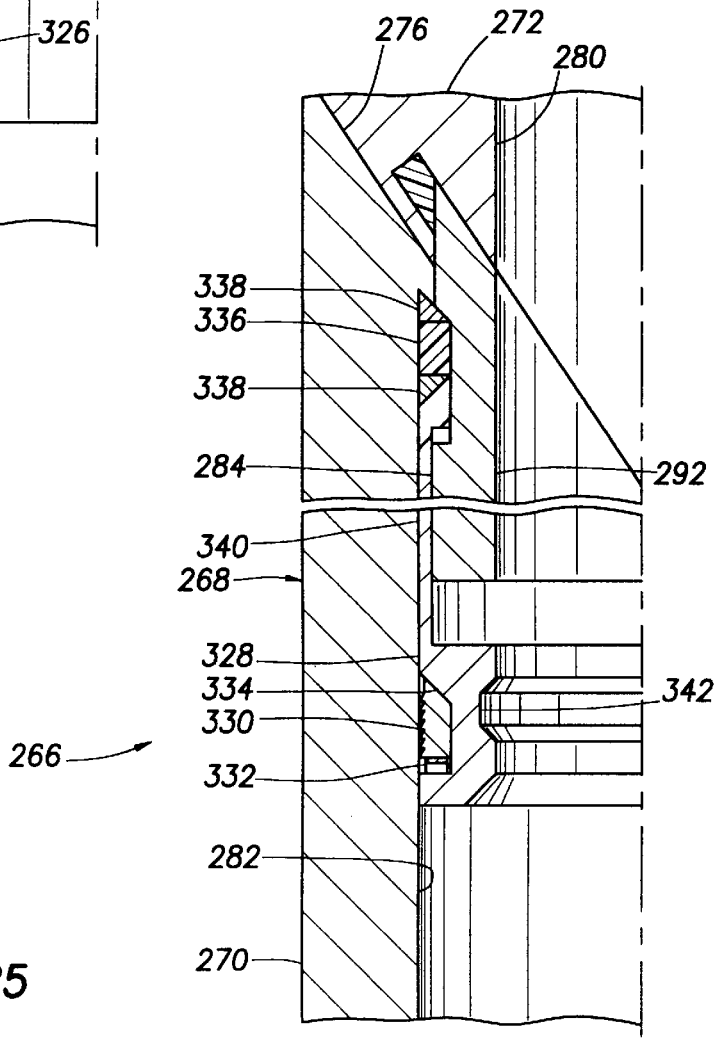

In FIG. 25, a device 328 is used to anchor the sleeve 284 relative to the housings 270, 272, in order to maintain sealing engagement between the sleeve and one or both of the housings. As shown in FIG. 25, the device 328 includes an anchoring portion 330, representatively illustrated as one or more slip members carried externally on the sleeve 284 and grippingly engaging the flow passage 282 within the lower housing 270.

The slips 330 are circumferentially distributed about the sleeve 284 and preferably permit upward displacement of the sleeve relative to the housing 270, but prevent downward displacement of the sleeve relative to the housing. This preferred operation of the slips 330 is facilitated by an upwardly biasing force applied to each of the slips 330 by a bias member or spring 332, which urges the slip into contact with an inclined face or wedge 334. Of course, the slips or other anchoring portion may be otherwise configured, and may restrict displacement of the sleeve in either axial direction, without departing from the principles of the present invention. For example, the anchoring portion may be configured similar to a conventional anchor, tubing hanger, packer, etc.

The device 328 also includes a sealing portion 336, which may be an annular seal element or member as shown in FIG. 25. The representatively illustrated seal element 336 is made of an elastomeric material and is axially compressed between annular generally wedge-shaped members 338 to radially outwardly extend the seal element into sealing engagement with the flow passage 282. Such axial compression of the seal element 336 is due to upward displacement of a tubular body portion 340 relative to the lower housing 270.

In operation, the sleeve 284 and device 328 are together upwardly shifted relative to the lower housing 270 after the upper housing 272 has been engaged and aligned with the lower housing. This may be accomplished by engaging a conventional shifting tool (not shown) with an internal annular profile 342 formed in the device 328. The sleeve 284 sealingly engages the upper housing 272 and is abutted therein, preventing further upward displacement of the sleeve. An upwardly directed force may then be applied to the device 328 via the shifting tool to axially compress the seal element 336, or otherwise extend the sealing element into sealing engagement between the sleeve 284 and the lower housing 270. The slips 330 prevent downward displacement of the sleeve 284 relative to the housing 270, thus preventing sealing disengagement of the sleeve from the upper housing 272, and preventing radial retraction and sealing disengagement of the seal element 336 from the lower housing 270.

Figure 26:
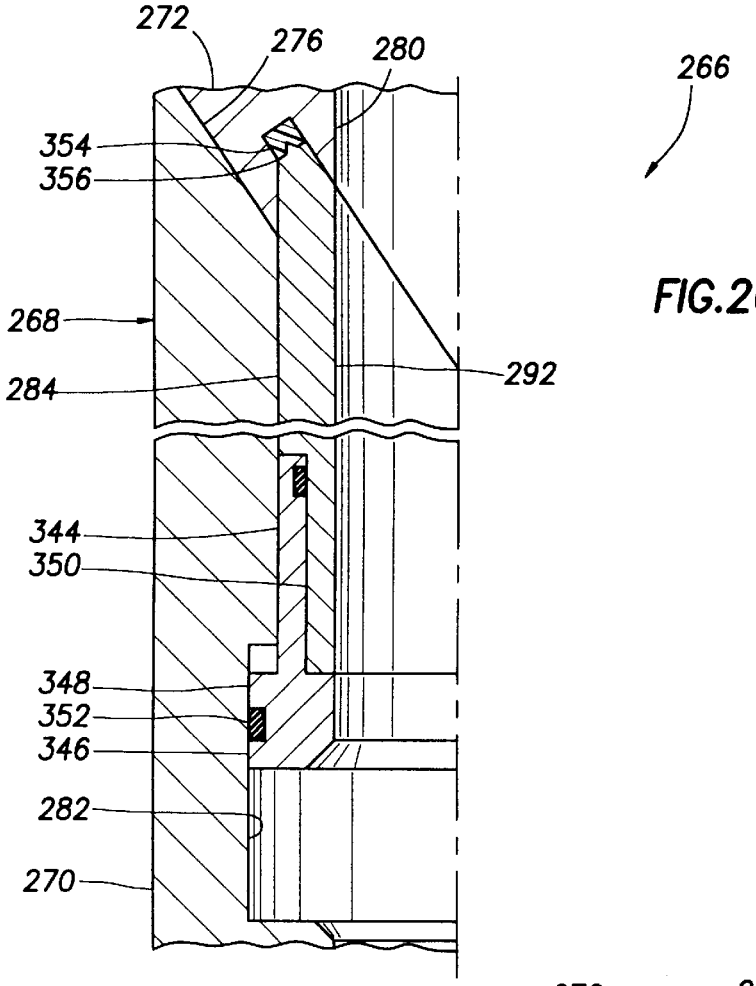

In FIG. 26, another device 344 for maintaining sealing engagement of the sleeve 284 is representatively illustrated, the device utilizing fluid pressure to upwardly bias the sleeve. The device 344 includes an annular piston 346 having at least two sealing diameters 348, 350 at which the piston sealingly engages the lower housing 270 and the sleeve 284, respectively. Note that the sealing diameter 346 is larger than the sealing diameter 350.

Due to the difference in the diameters 348, 350, it will be readily appreciated that fluid pressure in the flow passage 282 will upwardly bias the piston 346. Fluid pressure applied externally to the assembly 268 between a seal 352 carried externally on the piston 346 and a seal 354 carried internally on the upper housing 272, and with which the upper end of the sleeve 284 is sealingly engaged, will downwardly bias the piston. When the piston 346 is upwardly biased by fluid pressure, it axially contacts the sleeve 284 and maintains its sealing engagement with the seal 354 as shown in FIG. 26.

Note that the sleeve 284 sealingly engages the seal 354 at an effective diameter 356, which is less than the diameter 350. Thus it will be readily appreciated that fluid pressure applied externally to the assembly 268 will upwardly bias the sleeve 284, and fluid pressure in the flow passage 282 will downwardly bias the sleeve. Therefore, the sleeve 284 is upwardly biased by fluid pressure external to the assembly 268, thereby maintaining its sealing engagement with the seal 354.

When fluid pressure in the flow passage 282 upwardly biases the piston 346, it also downwardly biases the sleeve 284. However, the downwardly biasing force on the sleeve 284 is exceeded by the upwardly biasing force on the piston 346, thus resulting in a net biasing force directed upwardly on the sleeve. This is due to the fact that the difference in area between the diameters 348, 350 is greater than the difference in area between the diameters 350, 356. Therefore, no matter whether fluid pressure is applied internally or externally, or both, to the assembly 268 the sleeve 284 is upwardly biased toward sealing engagement with the seal 354.

Figure 27:
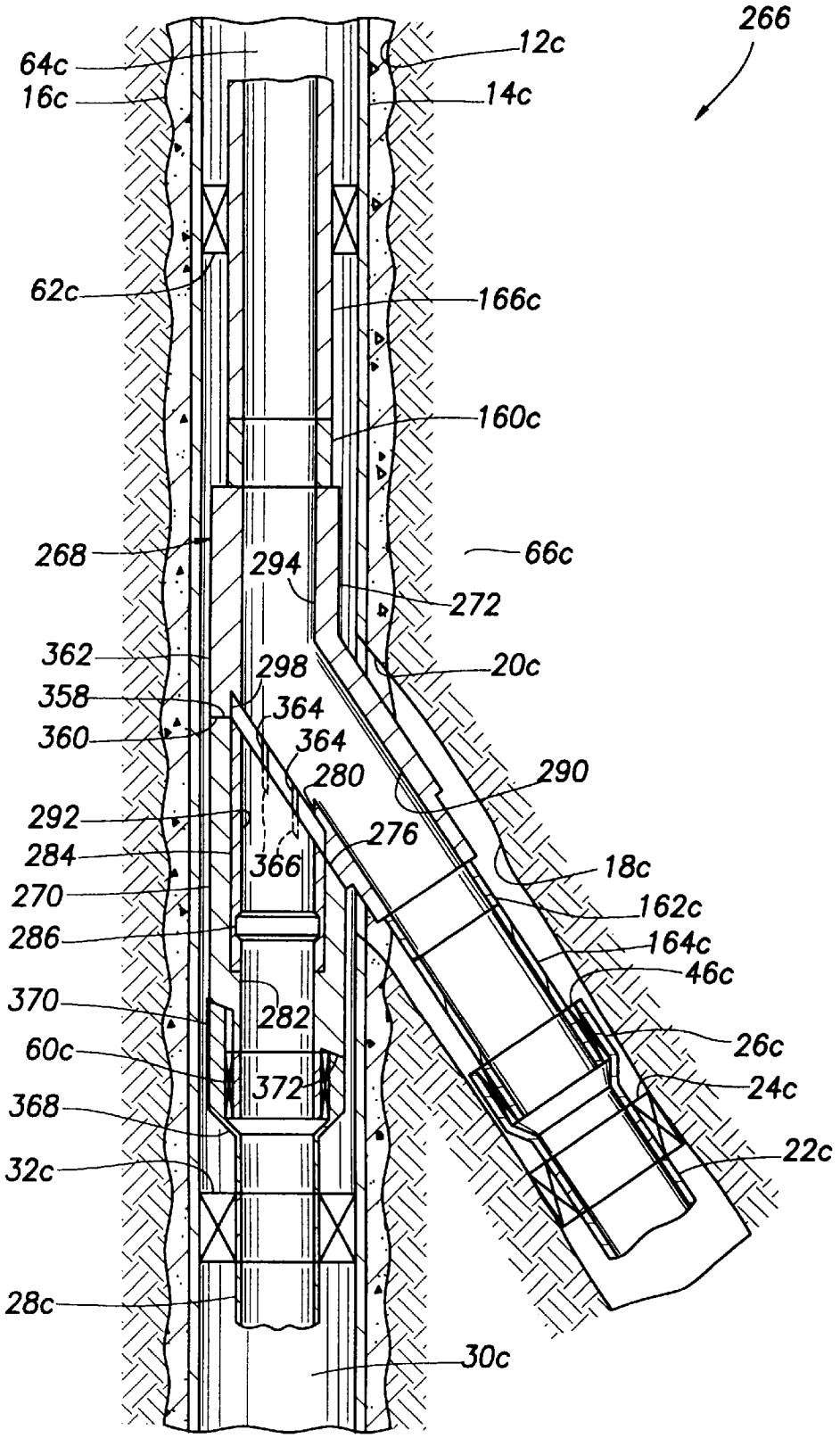
FIG. 27 is a cross-sectional view of a seventh method and apparatus embodying principles of the present invention.

In FIG. 27, an alternate configuration of the assembly 268 is shown installed in the well. Elements shown in FIG. 27 which are similar to those previously described are indicated using the same reference numbers, with an added suffix "c". The assembly 268 is shown in FIG. 27 after the housing 272 has been engaged and aligned with the housing 270, but prior to the sleeve 284 being shifted into sealing engagement with each of the housings.

The assembly 268 is substantially similar to the assembly shown in FIG. 19 above in many respects. However, instead of the engaged shoulders 274, 278, the assembly 268 shown in FIG. 27 utilizes lateral shoulders 358, 360, the shoulder 358 being formed on an upper portion of the laterally inclined surface 276. The shoulder 360 is formed on the sidewall 362 of the housing 272, through which the flow passage 280 extends. Engagement of the shoulders 358, 360 appropriately positions the upper housing 272 with respect to the lower housing 270.

Additionally, the sleeve 284 and upper housing 272 are configured in a manner that enhances stability of the assembly 268, maintaining the housings 270, 272 in appropriate alignment. For this purpose, the housing 272 has a series of splines, ribs or interlocking profiles 364 formed on the enlarged bore 298, which are slidably engageable with a corresponding series of complementarily shaped recesses or interlocking profiles 366 formed externally on the sleeve 284. The profiles 364, 366 may, for example, be dovetail-shaped.

The profiles 364, 366 extend in a direction parallel to an axis of the flow passages, 280, 282. Thus, when the sleeve 284 is displaced upwardly to sealingly engage the upper housing 272, the profiles 364, 366 will engage and strengthen the housing 272-to-sleeve 284 engagement and thereby restrict or prevent displacement of the housing 272 laterally with respect to the housing 270.

Furthermore, FIG. 27 representatively indicates another method of rotationally orienting the lower housing 270 relative to the wellbore junction. Note that a PBR 368, in which the sealing device 60*c* is sealingly installed, has an upper laterally inclined or muleshoe portion 370, and that the lower end of the lower housing 270 has a complementarily shaped laterally inclined surface 372 formed thereon or otherwise attached thereto. When the lower housing 270 is installed in the well, the surface 372 engages the muleshoe 370, which operates to rotate the housing 270, so that the upper inclined surface 276 faces toward the lateral wellbore or wellbore-to-be-drilled 18c. The surface 372 may be fixed in its position relative to the remainder of the housing 270, or it may be separately attached to the housing 270 and appropriately oriented with respect thereto prior to or after the housing 270 is installed in the well.

Figure 28:
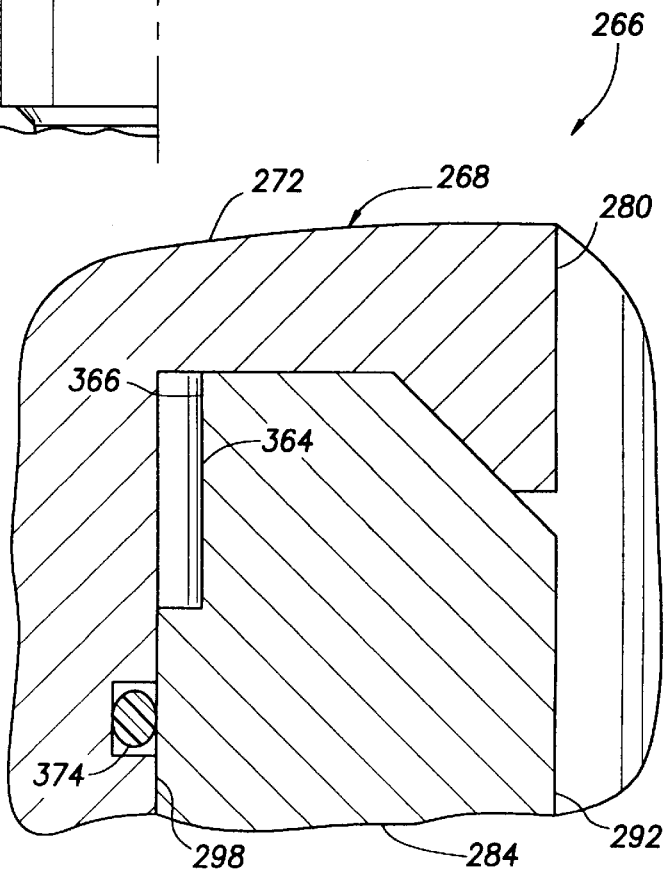
FIG. 28 is an enlarged cross-sectional view of a portion of the seventh apparatus.

In FIG. 28, an enlarged partial cross-section is shown of an upper portion of the sleeve 284 when it is upwardly shifted into engagement with the upper housing 272. In this view it may be seen that one of the profiles 364 is engaged in one of the profiles 366. Such engagement of the profiles 364, 366 may function to prevent or restrict radially inward deformation of the sleeve 284 due to external pressure applied thereto. For example, if the profiles 364, 366 are generally dovetail-shaped, engagement therebetween may prevent radial displacement of the sleeve 284 relative to the portion 298.

A sealing device, such as an oring 374, is carried internally on the upper housing 272 and sealingly engages the sleeve 284 when it is shifted into engagement with the upper housing. The sleeve 284 is also sealingly engaged with the lower housing 270 using any of the methods described above, for example, those shown in FIGS. 19–26, or by any other method.

Referring additionally now to FIGS. 29–32, various flexible couplings and methods of producing same are representatively and schematically illustrated. The flexible couplings shown in FIGS. 29–32 may be used for the flexible couplings 160,162 shown in FIGS. 6, 18 & 27, and may be used in other methods as well, without departing from the principles of the present invention.

Figure 29:
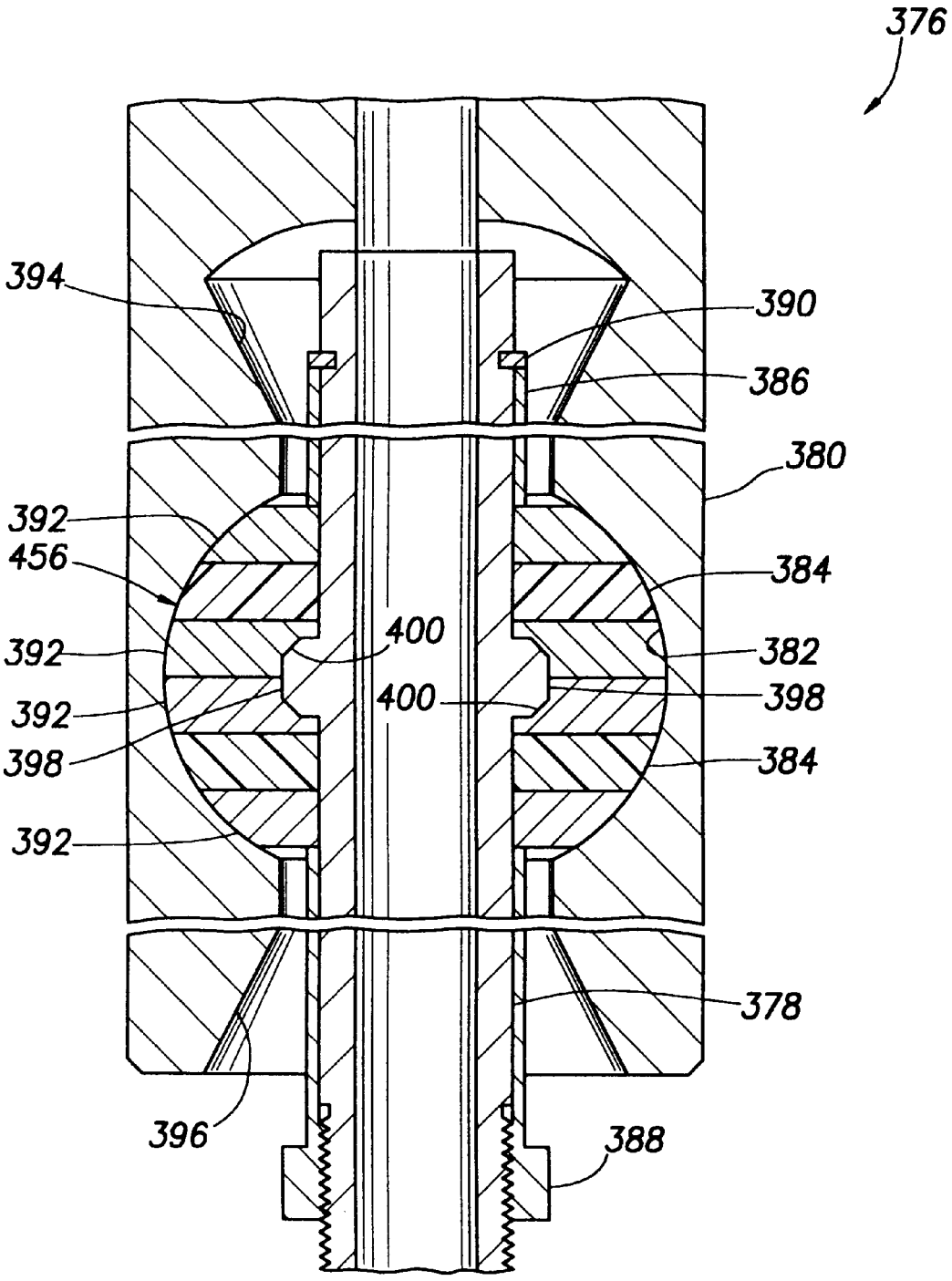
FIG. 29 is a cross-sectional view of an eighth apparatus embodying principles of the present invention.

In FIG. 29 a flexible coupling 376 is shown which includes a tubular member 378 sealingly and pivotably received within a tubular outer housing 380. The housing 380 and tubular member 378 are preferably adapted for interconnection to other tubular members, such as the housing 142 and tubular members 164, 166 shown in FIG. 6, for example, by threads formed thereon, but they may be otherwise configured without departing from the principles of the present invention.

The housing 380 has an internal cavity 382 which is generally spherical-shaped, but which is laterally oblong for purposes that will be described more fully below. Note, however, that the cavity 382 may be spherical, or may be otherwise shaped, without departing from the principles of the present invention.

The tubular member 378 has one or more generally annular-shaped seal members 384 disposed thereon and sealingly engaged between the tubular member 378 and housing 380 in the cavity 382. The seal members 384 are axially compressed between an abutment member or sleeve 386 and an internally threaded biasing member or sleeve 388 disposed externally on the tubular member 378. The seal members 384 are axially compressed by rotating the sleeve 388 on the tubular member 378 (which is externally threaded) to thereby displace the sleeve 388 toward the other sleeve 386. The sleeve 386 is secured to the tubular member 378 by means of a snap ring 390 or other retainer member.

Axial compression of the seal members 384 causes the seal members to extend radially and sealingly engage the housing 380 and/or tubular member 378. In any event, the seal members 384 are sealingly engaged with each of the housing 380 and tubular member 378. The seal members 384 are retained between substantially inflexible plates 392, which are complementarily shaped relative to the cavity 382 and tubular member 378. Thus, it will be readily appreciated that, if the tubular member 378 is pivoted within the housing 380 about a lateral axis relative to the housing 380, the seal members 384 and plates 392 (combinatively forming a seal assembly 456) will be rotated together within the cavity 382 about that axis.

However, if the cavity 382 is laterally oblong as shown in FIG. 29, the tubular member 378 will be permitted to pivot about only a single lateral axis with respect to the housing 380. Thus, the middle portion of FIG. 29 is shown 90 degrees rotated about the longitudinal axis of the housing 380 with respect to the upper and lower portions of FIG. 29, so that it may be seen that the laterally oblong cavity 382 permits pivoting of the tubular member 378 about a lateral axis 90 degrees from that of the oblong cavity. A recess 394 is formed within the housing 380 and a recess 396 is formed in an end of the housing, to accommodate such pivoting of the tubular member 378 relative to the housing.

Note that, if the cavity 382 is oblong, the seal members 384 and plates 392 are not permitted to rotate about the longitudinal axis of the housing 380. Thus, torque may be transmitted from the housing to the seal members 384 and plates 392. This torque may also be transmitted to the tubular member 378 by means of projections 398 extending laterally outwardly therefrom and engaged in complementarily shaped recesses 400 formed in selected ones of the plates 392. Therefore, the flexible coupling 376 may transmit torque from one of its opposite ends to the other.

In FIG. 30, a simplified form of a flexible coupling 402 and a method 404 of constructing the flexible coupling are shown. In the method 404, a generally tubular member 406 is inserted within an outer housing 408 having an internal generally spherical-shaped cavity 410 formed therein. The right side of FIG. 30 shows the tubular member 406 as it is initially inserted into the housing 408, and the left side of FIG. 30 shows the tubular member after it has been outwardly deformed into complementary engagement with the cavity 410. A circumferential seal 412 is carried externally on the tubular member 406 for sealing engagement with the housing 408 within the cavity 410 after the tubular member is deformed.

To deform the tubular member 406, an expander tool 414 may be inserted into the tubular member. An annular elastomeric member 416 of the tool is then axially compressed between an annular bushing 418 and a radially enlarged head 420 of a threaded rod 422 which extends axially through the bushing and the elastomeric member. A generally tubular threaded member 424 may be rotated with respect to the threaded rod 422 to thereby displace the head 420 toward the bushing 418 and axially compress the elastomeric member 416 therebetween.

Note that an anti-friction or friction reducing membrane 426 may be positioned radially between the tubular member 406 and the housing 408 prior to deforming the tubular member, so that the membrane 426 is disposed radially between the tubular member and the housing in the cavity 410 after the tubular member has been deformed.

After the tubular member 406 has been deformed, it may be pivoted within the cavity 410 about any lateral axis relative to the housing 408. However, it is to be clearly understood that the cavity 410 and/or tubular member 406 may be otherwise shaped so that pivoting of the tubular member is permitted only about certain lateral axes of the housing and/or so that the flexible coupling 402 is capable of transmitting torque, without departing from the principles of the present invention. For example, the cavity 410 may be formed laterally oblong similar to the cavity 382 shown in FIG. 29 to prevent rotation of the tubular member 406 relative to the cavity about the longitudinal axis of the housing 408.

In FIG. 31, another flexible coupling 428 and method 430 of producing the coupling are shown. In the method 430, a generally spherical end portion 432 of a tubular member 434 is inserted into an at least partially sphericalshaped internal cavity 436 of an outer housing 438. A peripheral end portion 440 of the housing 438 is then inwardly deformed to thereby complementarily retain the tubular member end portion 432 within the cavity 436. The interior surface of the housing end portion 440 may thus become a portion of the internal cavity 436.

A circumferential seal 442 may be carried externally on the tubular member end portion 432 for sealing engagement with the housing 438. One or more pins 444 may be installed through the housing 438 and received in slots or recesses 446 formed externally on the end portion 432 to transmit torque between the housing and the tubular member 434. Alternatively, the cavity 436 may be formed laterally oblong similar to the cavity 382 shown in FIG. 29 to prevent rotation of the tubular member 434 relative to the cavity about the longitudinal axis of the housing 438.

Figure 32:
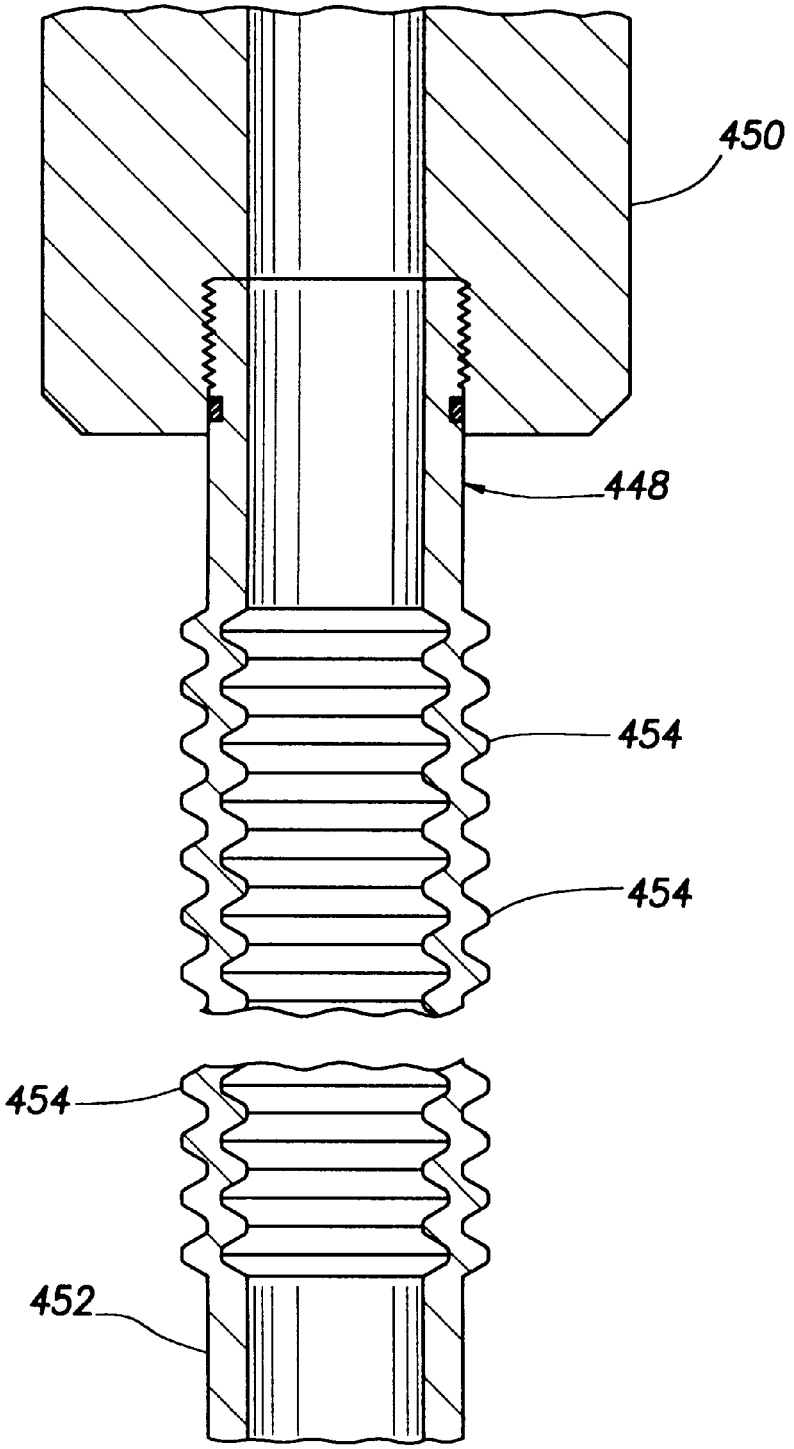
FIG. 32 is a cross-sectional view of an eleventh apparatus embodying principles of the present invention.

In FIG. 32, a flexible coupling 448 is shown sealingly and threadedly attached to a tubular member 450. The flexible coupling 448 is substantially a one-piece device comprising a tubular body 452 having a series of folds, creases, or corrugations 454 formed thereon. The folds 454 permit the body portion 452 to be deflected laterally relative to the tubular member 450. The portion of the body 452 having the folds 454 thus has substantially greater flexibility than the remainder of the body. Note that the body 452 is also capable of transmitting torque from one of its opposite ends to the other, and is capable of containing or withstanding fluid pressure applied internally or externally thereto.

Of course, many modifications, additions, substitutions, deletions, and other changes may be made to the various apparatus and methods described above, which would be obvious to a person skilled in the art, and such changes are contemplated by the principles of the present invention. For example, in several of the apparatus described above, sealing devices have been described for use therewith which are extendable, expandable, inflatable, etc., but it is to be clearly understood that other types of seals, such as interference-fit seals (e.g., orings and other seals that are compressed for sealing engagement between members) may be used in place of these seals. Accordingly, the foregoing detailed description is to be clearly understood as being given by way of illustration and example only, the spirit and scope of the present invention being limited solely by the appended claims.

What is claimed is:

1. Apparatus for completing a wellbore junction, the apparatus comprising:

a first housing having an axial flow passage formed therethrough and a lateral flow passage formed through a sidewall portion of the first housing; and a second housing having an axial flow passage formed therethrough, the second housing being slidingly engaged with the first housing sidewall portion without passing the second housing through the first housing, and the second housing axial flow passage being in fluid communication with the first housing lateral flow passage.

2. The apparatus according to claim 1, wherein the second housing has a projection extending outwardly from a sidewall portion thereof, the projection preventing displacement of the second housing relative to the first housing.

3. The apparatus according to claim 2, wherein the projection is engageable with a periphery of an opening extending outwardly from a wellbore in which the first housing is disposed.

4. The apparatus according to claim 1, wherein the engagement between the first and second housings is maintained by an anchoring device attached to the first housing.

5. The apparatus according to claim 1, wherein the engagement between the first and second housings is maintained by an anchoring device attached to the second housing.

6. The apparatus according to claim 1, wherein interlocking profiles are formed on each of the first and second housings, the interlocking profiles preventing lateral displacement of the second housing relative to the first housing.

7. The apparatus according to claim 6, further comprising a sealing device disposed between the first and second housings.

8. The apparatus according to claim 7, wherein the sealing device seals between the interlocking profiles.

9. The apparatus according to claim 1, further comprising a sealing device sealingly engaged with each of the first and second housings and forming a pressure-bearing seal between the first housing lateral flow passage and the second housing axial flow passage.

10. The apparatus according to claim 9, wherein the sealing device is expandable from a first configuration in which the sealing device is not sealingly engaged with both of the first and second housings to a second configuration in which the sealing device is sealingly engaged with both of the first and second housings.

11. The apparatus according to claim 10, wherein the sealing device is an inflatable seal.

12. The apparatus according to claim 11, wherein the seal is inflatable via a line attached to the first housing.

13. The apparatus according to claim 11, wherein the seal is inflatable via a propellant device disposed in communication with an internal chamber of the seal.

14. The apparatus according to claim 11, wherein the seal is inflatable via an explosive device disposed in communication with an internal chamber of the seal.

15. The apparatus according to claim 11, wherein the seal includes a generally tubular body portion.

16. The apparatus according to claim 15, wherein, in the second configuration, the body portion sealingly engages each of the first and second housings.

17. The apparatus according to claim 16, wherein the body portion forms a metal-to-metal seal with at least one of the first and second housings in the second configuration.

18. The apparatus according to claim 15, further comprising a sealing material carried externally on the body portion.

19. The apparatus according to claim 15, wherein the body portion penetrates a surface of at least one of the first and second housings in the second configuration.

20. The apparatus according to claim 10, wherein a generally tubular body portion of the sealing device is compressed in the first configuration, and wherein the body portion is extended in the second configuration.

21. The apparatus according to claim 1, further comprising a sleeve axially and exteriorly disposed relative to the first housing, the sleeve being slidably engaged with the second housing.

22. The apparatus according to claim 21, wherein the sleeve is axially slidably disposed relative to a tubular member in which the first housing is disposed.

23. The apparatus according to claim 21, wherein the sleeve prevents lateral displacement of the second housing relative to a tubular member, the second housing extending laterally through a sidewall portion of the tubular member.

24. The apparatus according to claim 21, wherein the sleeve is externally slidably disposed relative to casing in which the first housing is disposed.

25. A method of completing a wellbore junction, the method comprising the steps of:

slidingly engaging a first housing with a second housing disposed at least partially in a lateral wellbore and extending into a parent wellbore without passing the second housing through the first housing, the first housing having an axial flow passage formed therethrough and a lateral flow passage formed through a sidewall portion of the first housing, and the second housing having an axial flow passage formed therethrough; and permitting fluid communication between the second housing axial flow passage and the first housing lateral flow passage.

26. The method according to claim 25, further comprising the step of preventing displacement of the second housing relative to the first housing by engaging a projection extending outwardly from a sidewall portion of the second housing with a portion of one of the parent and lateral wellbores.

27. The method according to claim 26, wherein the preventing step is performed by engaging the projection with a periphery of an opening formed between the parent and lateral wellbores.

28. The method according to claim 25, further comprising the step of maintaining engagement between the first and second housings by setting an anchoring device attached to the first housing.

29. The method according to claim 25, further comprising the step of maintaining engagement between the first and second housings by setting an anchoring device attached to the second housing.

30. The method according to claim 25, wherein the engaging step further comprises engaging interlocking profiles formed on each of the first and second housings, the interlocking profiles preventing lateral displacement of the second housing relative to the first housing.

31. The method according to claim 30, further comprising the step of sealingly engaging the first and second housings with a sealing device disposed therebetween.

32. The method according to claim 31, wherein the sealingly engaging step further comprises utilizing the sealing device to seal between the interlocking profiles.

33. The method according to claim 25, further comprising the step of forming a pressure-bearing seal between the first housing lateral flow passage and the second housing axial flow passage utilizing a sealing device sealingly engaged with each of the first and second housings.

34. The method according to claim 33, wherein the seal forming step further comprises expanding the sealing device from a first configuration in which the sealing device is not sealingly engaged with both of the first and second housings to a second configuration in which the sealing device is sealingly engaged with both of the first and second housings.

35. The method according to claim 34, further comprising the step of providing the sealing device as an inflatable seal.

36. The method according to claim 35, wherein the expanding step further comprises inflating the seal via a line attached to the first housing.

37. The method according to claim 35, wherein the expanding step further comprises inflating the seal utilizing a propellant device disposed in communication with an internal chamber of the seal.

38. The method according to claim 35, wherein the expanding step further comprises inflating the seal utilizing an explosive device disposed in communication with an internal chamber of the seal.

39. The method according to claim 35, wherein the providing step further comprises providing the seal including a generally tubular body portion.

40. The method according to claim 39, wherein the expanding step further comprises sealingly engaging the body portion with each of the first and second housings.

41. The method according to claim 40, wherein the expanding step further comprises forming a metal-to-metal seal between the body portion and at least one of the first and second housings.

42. The method according to claim 39, wherein in the seal providing step, the seal includes a sealing material carried externally on the body portion.

43. The method according to claim 39, wherein the expanding step further comprises penetrating a surface of at least one of the first and second housings with the body portion.

44. The method according to claim 34, wherein in the expanding step, a generally tubular body portion of the sealing device is circumferentially compressed in the first configuration and circumferentially extended in the second configuration.

45. The method according to claim 25, further comprising the step of slidably engaging a sleeve with the second housing, the sleeve being axially and exteriorly disposed relative to the first housing.

46. The method according to claim 45, further comprising the step of axially slidably disposing the sleeve relative to a tubular member in which the first housing is disposed.

47. The method according to claim 45, wherein the sleeve engaging step further comprises preventing lateral displacement of the second housing relative to a tubular member, the second housing extending laterally through a sidewall portion of the tubular member.

48. The method according to claim 45, further comprising the step of slidably disposing the sleeve externally relative to casing in which the first housing is disposed.

* * * * *